US007360655B2

(12) United States Patent
Johannsen

(10) Patent No.: US 7,360,655 B2
(45) **Date of Patent: *Apr. 22, 2008**

(54) MATERIAL HANDLING SYSTEM HAVING A SCOOP WHEEL

(75) Inventor: Thor J. Johannsen, Norval (CA)

(73) Assignee: Thor Global Enterprises Ltd., Mississauga, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/123,943

(22) Filed: May 6, 2005

(65) Prior Publication Data

US 2005/0210714 A1 Sep. 29, 2005

Related U.S. Application Data

(63) Continuation-in-part of application No. 10/984,486, filed on Nov. 9, 2004.

(60) Provisional application No. 60/572,602, filed on May 20, 2004.

(30) Foreign Application Priority Data

Nov. 10, 2003 (CA) ..... 2448857

(51) Int. Cl.
*B03B 7/00* (2006.01)
*B03B 11/00* (2006.01)

(52) U.S. Cl. ..... 209/18; 209/162; 209/208; 209/492

(58) Field of Classification Search ..... 209/18, 209/492, 684, 686, 485, 491; 198/713, 509, 198/519, 861.1; 210/523, 297, 330
See application file for complete search history.

(56) References Cited

U.S. PATENT DOCUMENTS

| | | | | | |
|---|---|---|---|---|---|
| 924,682 | A | * | 6/1909 | Maignen | 209/155 |
| 1,107,472 | A | | 8/1914 | Allen | |
| 1,291,768 | A | * | 1/1919 | Cole | 476/28 |
| 1,350,154 | A | * | 8/1920 | Hamilton | 209/492 |
| 2,106,156 | A | * | 1/1938 | Munro | 209/463 |
| 2,226,750 | A | * | 12/1940 | Traylor et al. | 209/463 |
| 2,322,415 | A | * | 6/1943 | Buckbee | 210/330 |
| 2,453,293 | A | | 11/1948 | Aurilio et al. | |
| 2,521,152 | A | * | 9/1950 | Davis | 209/172.5 |
| 2,642,175 | A | * | 6/1953 | Mahoney | 198/315 |
| 2,709,514 | A | * | 5/1955 | Miller | 198/315 |
| 2,990,064 | A | | 6/1961 | Schoeneck | |
| 3,351,204 | A | * | 11/1967 | Anderson | 210/158 |
| 3,773,176 | A | | 11/1973 | Loughner | |
| 3,887,074 | A | * | 6/1975 | Bausier | 209/158 |
| 3,992,754 | A | * | 11/1976 | McCloskey et al. | 19/66 R |

(Continued)

FOREIGN PATENT DOCUMENTS

GB 2143444 A * 2/1985

(Continued)

*Primary Examiner*—Patrick Mackey
*Assistant Examiner*—Terrell Matthews
(74) *Attorney, Agent, or Firm*—Hodgson Russ LLP

(57) ABSTRACT

A material handling system is provided. The material handling system includes a tank defining a reservoir for receiving a solid material, and a wheel including a plurality of circumferentially spaced apart scoops for scooping solid material from the tank and subsequently discharging scooped solid material from the tank during rotation of the wheel.

19 Claims, 24 Drawing Sheets

U.S. PATENT DOCUMENTS

| | | | | | |
|---|---|---|---|---|---|
| 4,151,074 | A | | 4/1979 | Mohri | |
| 4,421,647 | A | * | 12/1983 | Estabrook et al. | 210/387 |
| 4,516,033 | A | * | 5/1985 | Olson | 290/54 |
| 4,543,180 | A | | 9/1985 | Riker | |
| 4,571,145 | A | * | 2/1986 | Hunter | 414/567 |
| 4,927,528 | A | * | 5/1990 | Doppstadt | 209/31 |
| 5,048,693 | A | * | 9/1991 | Zaltzman | 209/137 |
| 5,082,553 | A | * | 1/1992 | Tanii | 209/3 |
| 5,145,576 | A | * | 9/1992 | Lataillade | 210/180 |
| 5,232,100 | A | * | 8/1993 | Lewis | 209/537 |
| 5,290,401 | A | | 3/1994 | Savisalo et al. | |
| 5,437,788 | A | * | 8/1995 | Geibel et al. | 210/333.01 |
| 5,478,479 | A | * | 12/1995 | Herrig | 210/745 |
| 5,490,928 | A | | 2/1996 | Tanii | |
| 5,638,620 | A | * | 6/1997 | Van Der Kooy | 37/338 |
| 5,855,799 | A | * | 1/1999 | Herrmann | 210/780 |
| 5,868,256 | A | * | 2/1999 | Teppo | 209/173 |
| 6,227,379 | B1 | * | 5/2001 | Nesseth | 210/393 |
| 6,349,812 | B1 | * | 2/2002 | Epp et al. | 198/318 |
| 2003/0057055 | A1 | * | 3/2003 | Haukaas et al. | 198/313 |
| 2004/0168964 | A1 | * | 9/2004 | Lambert et al. | 210/221.1 |

FOREIGN PATENT DOCUMENTS

| | | |
|---|---|---|
| JP | 1 075 006 A2 | 3/1989 |
| WO | WO 02/32798 A1 | 4/2002 |

* cited by examiner

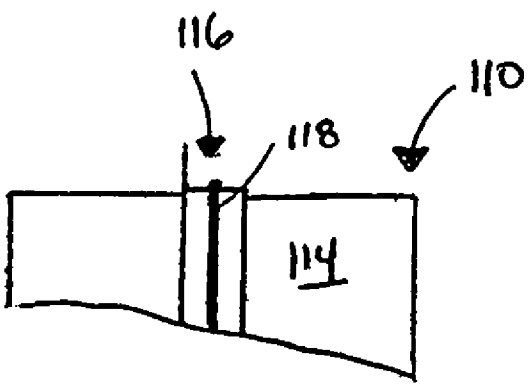
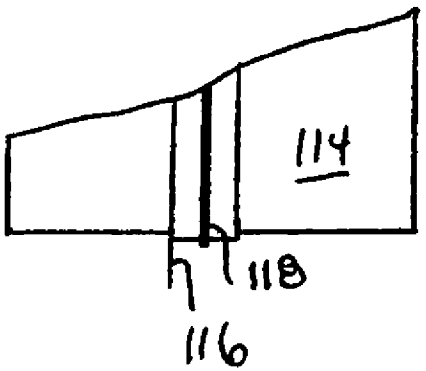
FIG. 14
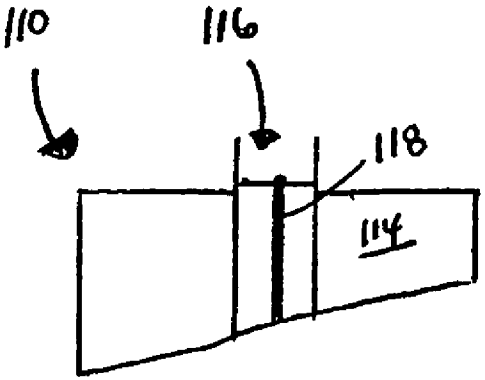
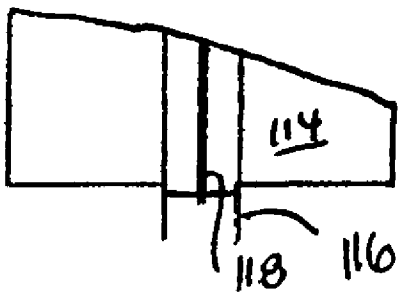
FIG. 15

MATERIAL HANDLING SYSTEM HAVING A SCOOP WHEEL

RELATED APPLICATION INFORMATION

This application is a continuation-in-part of U.S. patent application No. 10/984,486, filed Nov. 9, 2004, which claims priority to Canadian Patent Application No. 2,448,857 filed Nov. 10, 2003 and provisional U.S. patent application No. 60/572,602 filed May 20, 2004.

FIELD OF THE INVENTION

This application relates to a material handling system, and more particularly to a material handling system having a scoop wheel.

BACKGROUND

Material handling systems are used for many different purposes, including the separation or classification of solids according to size and/or particle density, and/or the movement of material from one place to another.

SUMMARY

A material handling system is described. The material handling system includes a tank defining a reservoir for receiving a material, and a wheel including a plurality of circumferentially spaced apart scoops for scooping material from the tank and subsequently discharging scooped material from the tank during rotation of the wheel.

BRIEF DESCRIPTION OF THE DRAWINGS

Reference will now be made to the accompanying drawings which show, by way of example, embodiments of the present invention, and in which:

FIG. 13 is a partial end view of a scoop wheel having a U-shaped guide circumferentially attached thereto;

FIG. 14 is a partial end view of a scoop wheel having a L-shaped guide circumferentially attached thereto;

Figure 1:
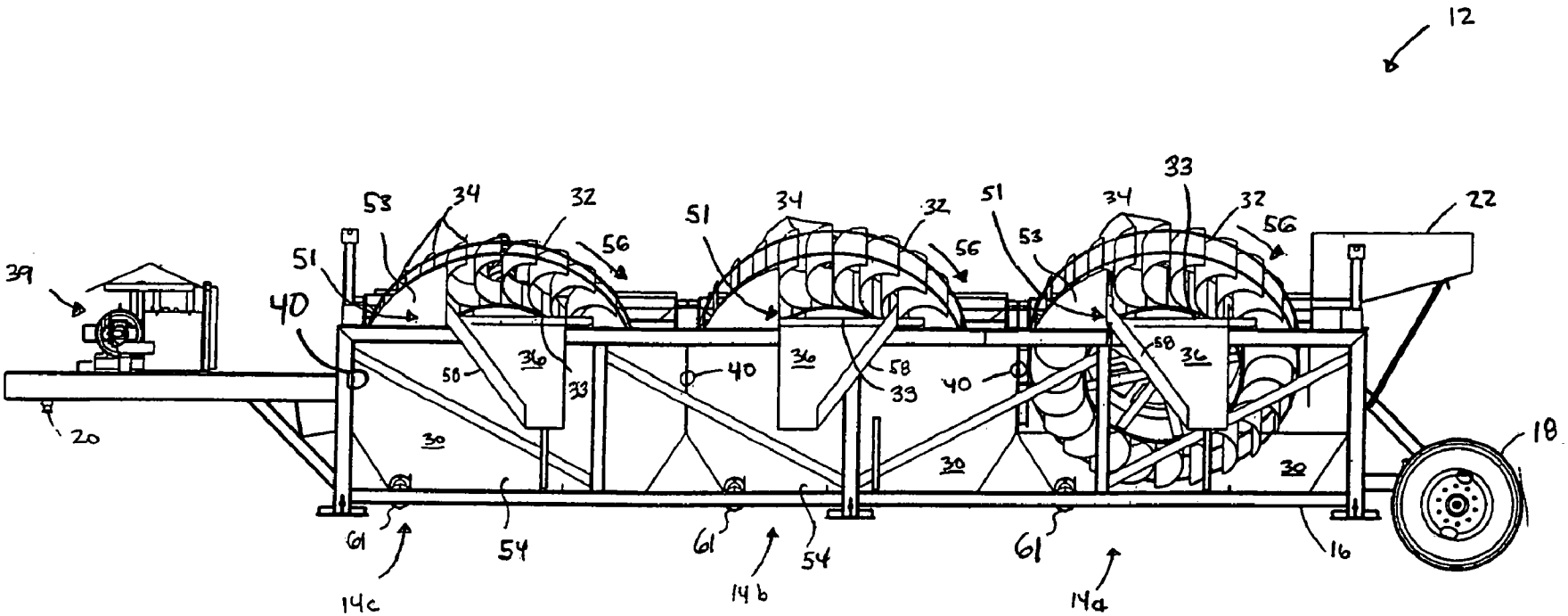
FIG. 1 is a side view of a material classifier constructed according to one embodiment of the present invention with a cut-away portion showing a scoop wheel.
Figure 2:
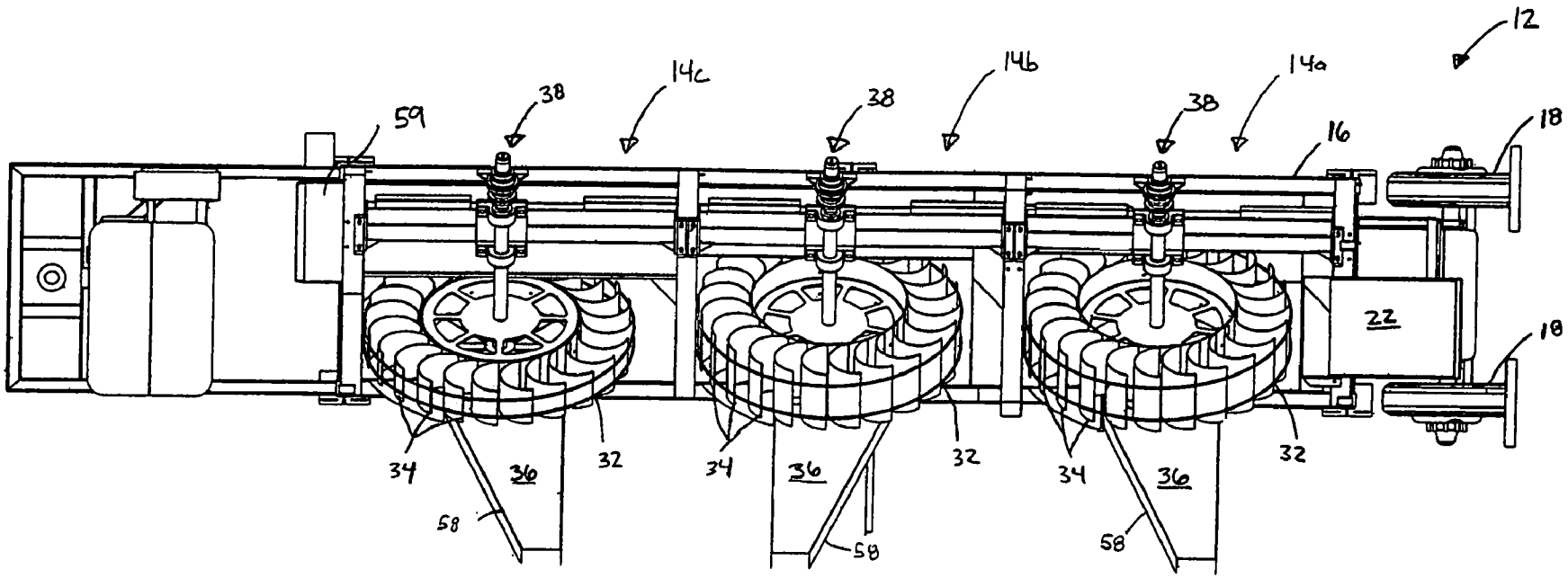
FIG. 2 is a top view of the material classifier of FIG. 1.
Figure 3:
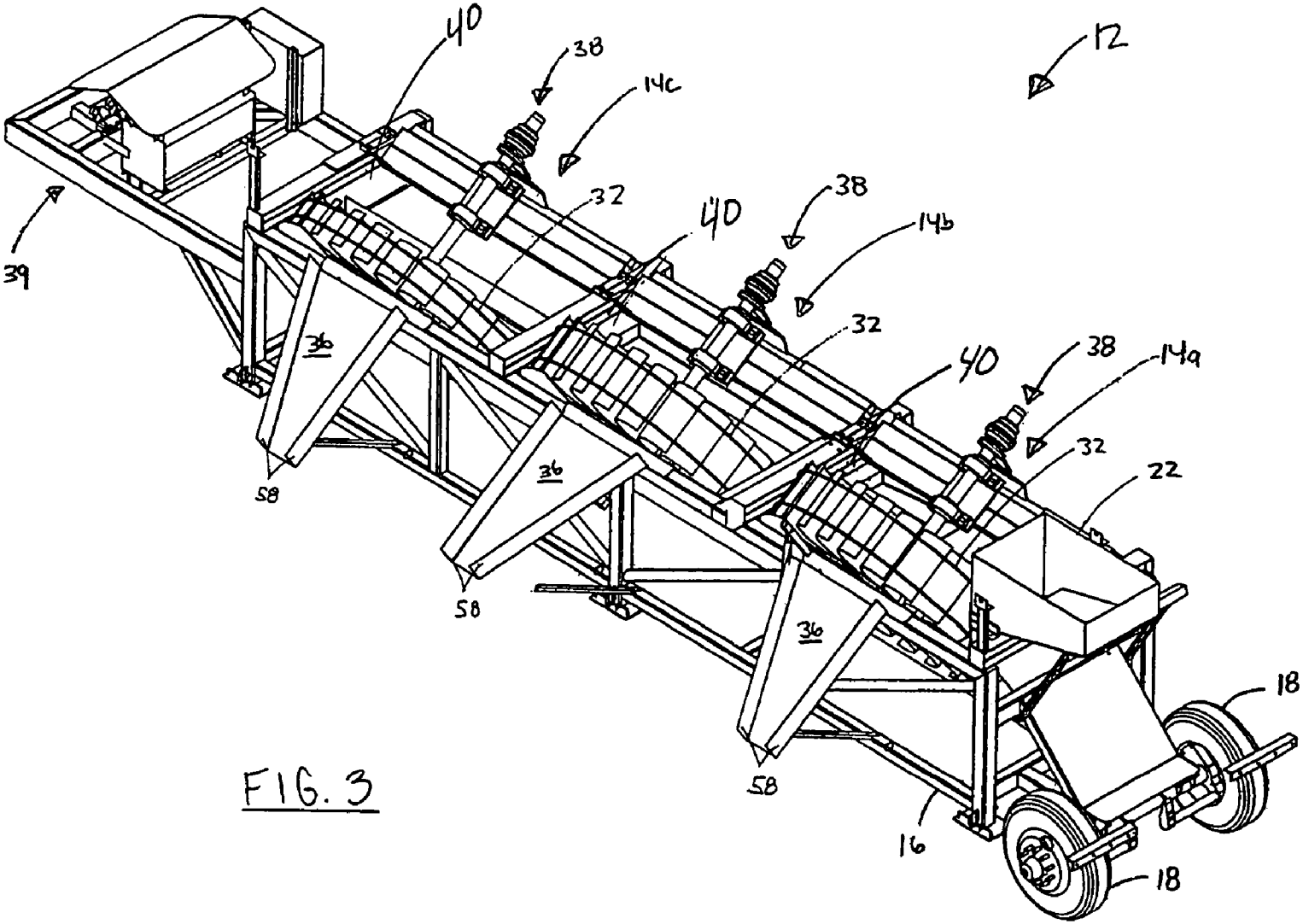
FIG. 3 is a perspective view of the material classifier of FIG. 1.
Figure 4:
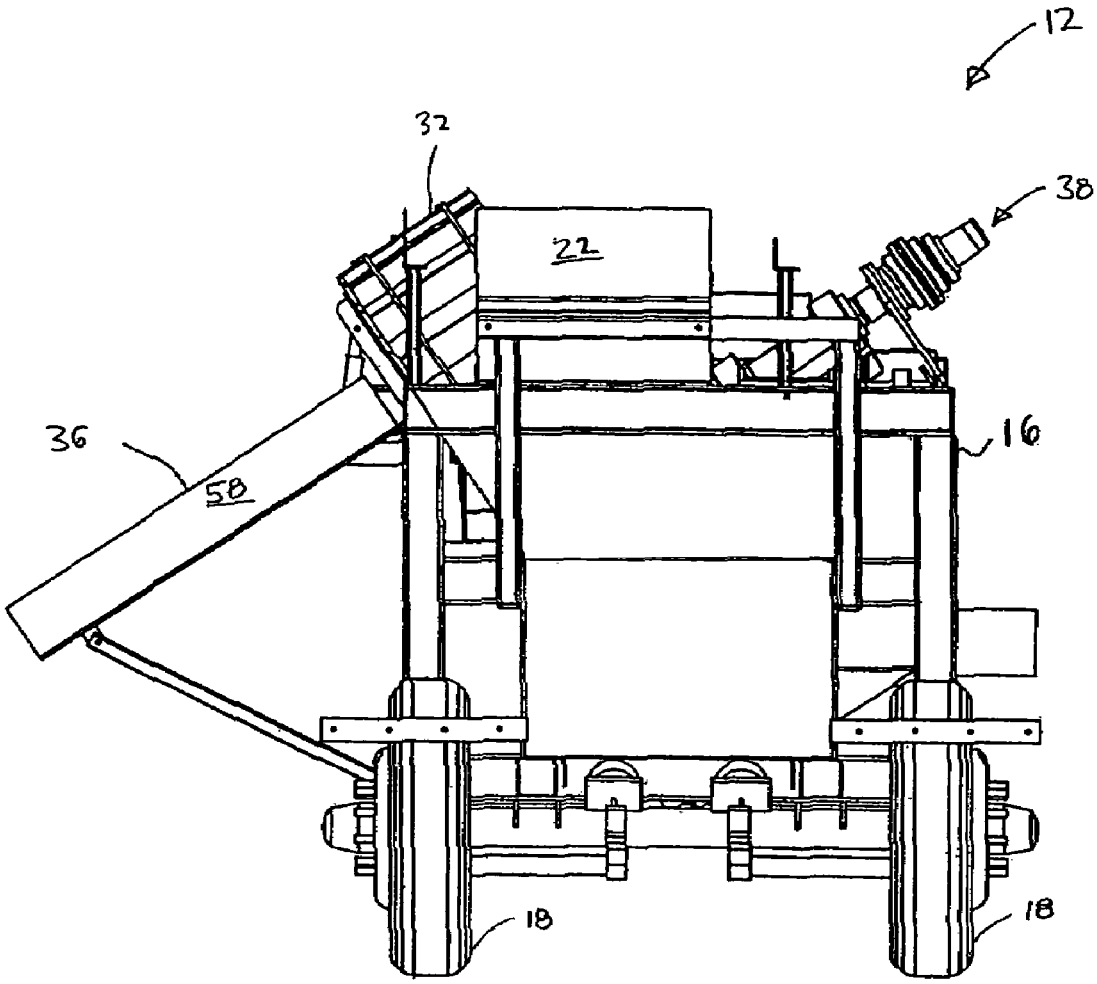
FIG. 4 is an end view of the material classifier of FIG. 1.

Similar references are used in different figures to denote similar components.

DETAILED DESCRIPTION OF THE EMBODIMENTS

Reference is first made to FIG. 1 to 4, which show a system 12 for classifying a liquid-solid mixture implemented according to the present invention. The system 12 comprises material classifiers 14, indicated individually by references 14*a*, 14*b* and 14*c*, a support frame 16, wheels 18, hitch 20, and a mixing box 22. The material classifiers 14 are coupled in succession to form a series of three classifier stages beginning with the first material classifier 14*a*. In other embodiments, greater or fewer stages may be used. A single material classifier 14 may be used, if desired.

Figure 6:
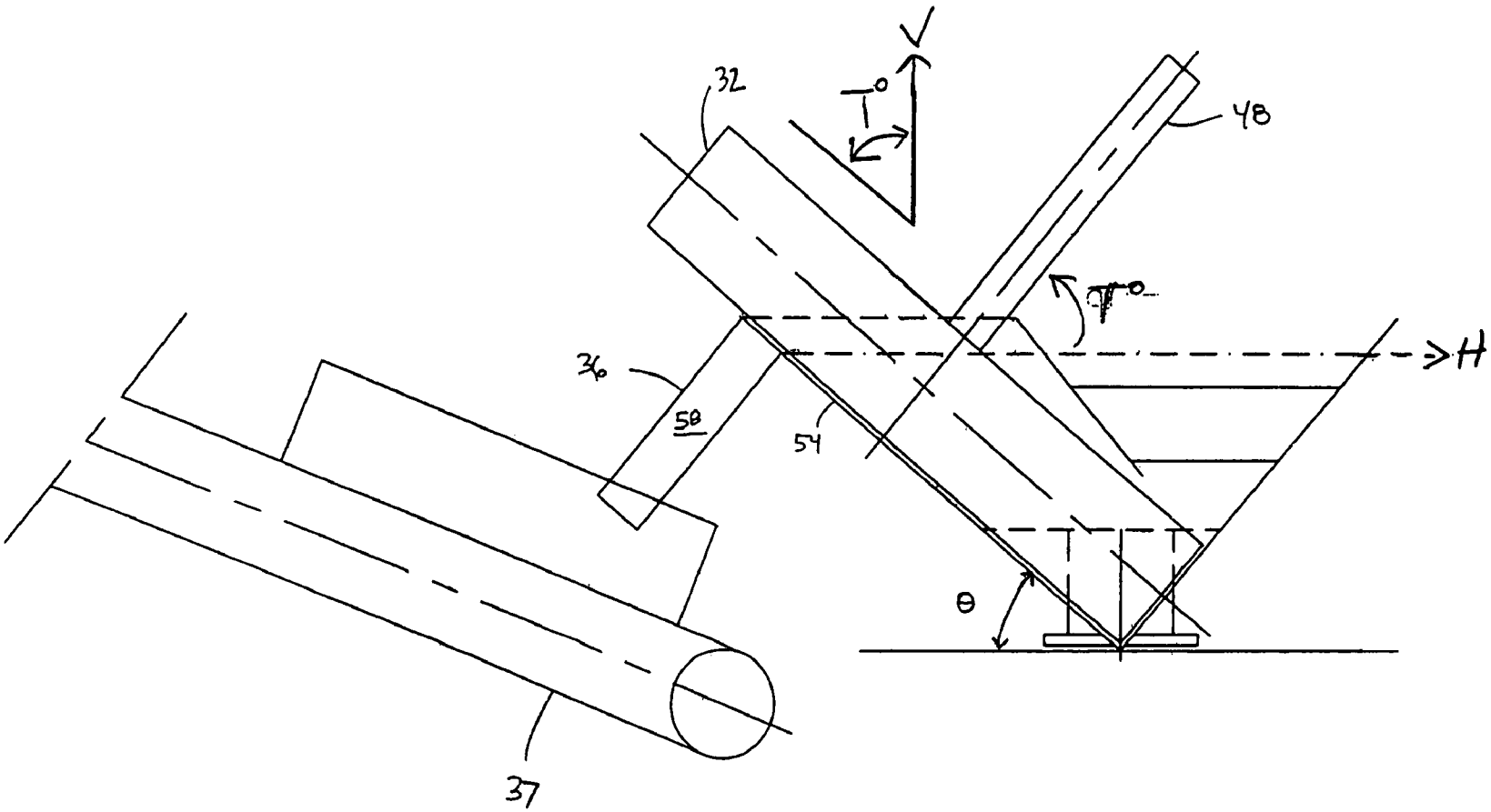
FIG. 6 is an schematic diagram of the material classifier of FIG. 1 associated with a conveyor belt for transport of discharged solid material.

Each material classifier 14 comprises a tank or hopper 30, and an angularly mounted scoop wheel 32 having a plurality of radially extending, curved scoops or lifts 34. The wheels 32 and their corresponding scoops 34 scoop settled material out of the tanks 30 and deposit it on discharge ramps or chutes 36. Each discharge chute 36 directs the scooped material onto a corresponding conveyor belt 37 (FIG. 6). The conveyor belt 37 which transports the material elsewhere, for example, to a discharge pile (not shown) for open storage. In other embodiments, the discharge chutes 36 may direct the scooped material to a common conveyor belt. Other transport means may be used to transport the material from the discharge chutes 36. Each of the wheels 32 is driven by an independently controllable drive mechanism 38. For example, in one embodiment each wheel drive mechanism 38 is a hydrostatic drive. An electric motor 39 powers three hydraulic pumps, each pump driving an independent hydrostatic drive. In other embodiments, alternative drive mechanisms are used, such as independent electric motors for each wheel, for example. In an example embodiment, the rate of rotation of the wheels 32 is different for each stage, with the wheel 32 in the first stage having a higher rpm than the wheel 32 in the second stage, which in turn has a higher rpm than the wheel in the third stage. Generally, slower rotation results in less agitation and allows lighter material to settle on the bottom of the tank 30 so that it can be collected by the scoops 34. However, slow rates of rotation reduce the rate at which settled material is collected from the tanks. Thus, process requirements are considered when selecting the appropriate rates of rotation for the wheels 32.

Figure 9A:
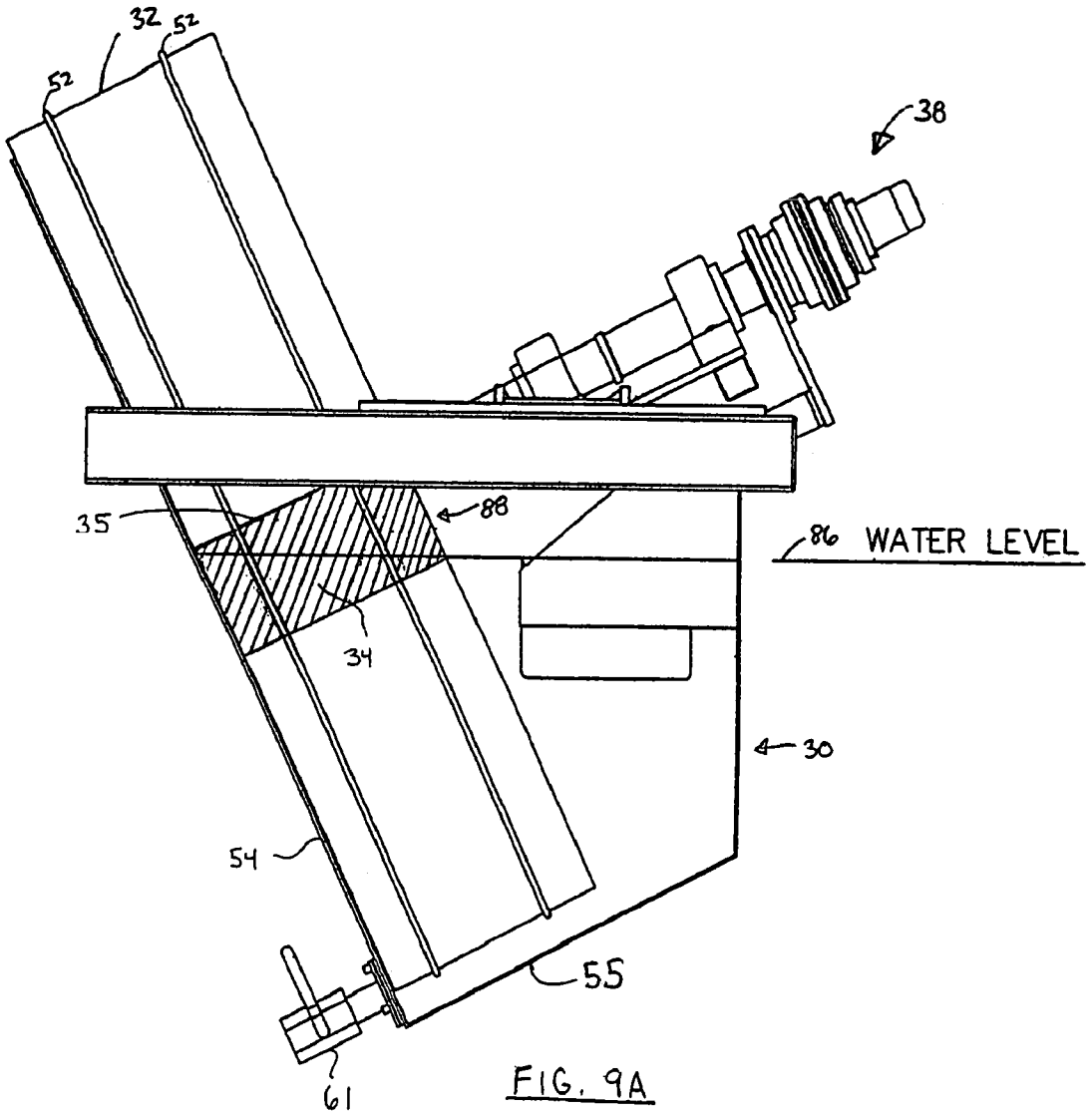
FIG. 9A is a sectional end view of the material classifier of FIG. 1 showing the water line in the tank during operation.

Referring now to FIGS. 6 and 9A, the tanks 30 will be described in more detail. The tanks 30 each have a bottom wall 55 and side wall 54 adjacent to the respective wheel 32. The side wall 54 includes a guard plate 53 in an upper portion of thereof. A discharge area or opening 51 is defined in the upper portion of the side wall 54 adjacent the guard plate 53. The discharge chutes 36 are attached to an outer surface of the side wall 54 each of the tanks 30 at an upper edge 33 of the side wall 54 in communication with the discharge opening 51. A drain 61 is provided in a lower portion of each side wall 54 for draining the respective tanks 30 during shutdown.

The angle of the side wall 54 corresponds to an angle T° at which the wheel 32 is mounted relative to a vertical reference "V", thus ensuring that substantially all of the solid material scooped up by the wheels 32 remains on the scoops 34 until the scoops 34 reach their respective discharge chutes 36. Alternatively, the tilt or angle of the side wall 54 can be defined in terms of horizontal reference. In such cases, the side wall 54 is positioned at an angle θ relative to a horizontal reference such as, for example, the base of the support frame 16.

When the scoops 34 reach the discharge chute 36, the scooped material carried by the scoops 34 falls down the chute 36 and onto the corresponding conveyor belt 37. The tanks 30 may also include an overflow weir or gate 40 between them. In some embodiments, the gates 40 define an opening allowing water and suspended material to pass through to the next stage in the classifier system. In other embodiments, there are no gates and the tanks 30 open into each other.

Figure 5:
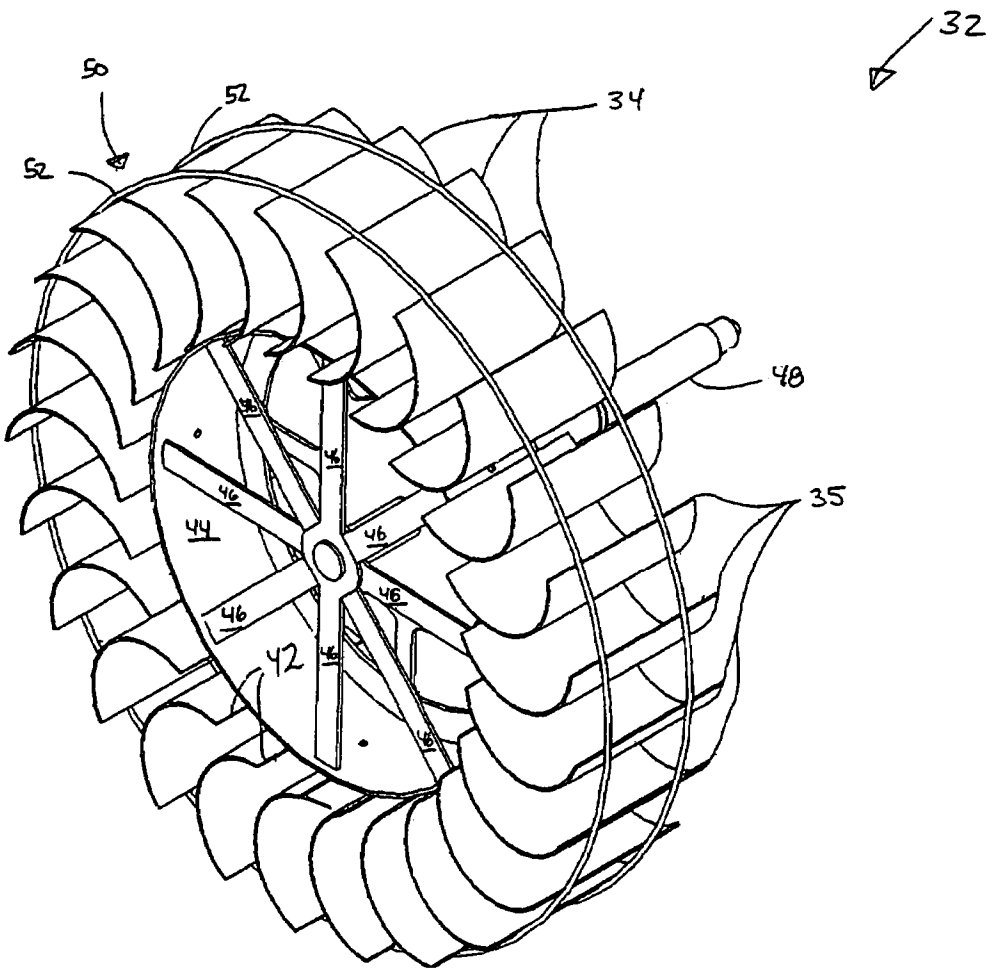
FIG. 5 is a perspective view of the scoop wheel of the material classifier of FIG. 1.

Referring now to FIG. 5, one embodiment of a wheel 32 will be described in more detail. Each wheel 32 comprises scoops or lifts 34, an inner hub 44, spokes 46, drive shaft 48, and an outer hub 50. As shown in FIG. 5, the inner hub 44 may comprise a substantially cylindrical wall or ring from which the scoops extend, at least some of the scoops having a width greater than that of the cylindrical wall. However in other embodiments the inner hub 44 may comprise two or more spaced apart concentric rings inset from respective end edges of the scoops 34. As shown in FIG. 5, the outer hub 50 comprises concentric support bars 52, however other configuration of the outer hub 50 are also possible. The drive shaft 48 of each wheel 32 is coupled to its corresponding drive mechanism 38 (FIG. 1-4). T° facilitate discharging of material from the scoops 34, the wheels 32 are angularly mounted to have at least a downwardly oriented side within the corresponding material classifier 14 at an angle T° relative to the vertical V (referred to as the tilt angle). Thus, the axis of rotation of each wheel 32 is oriented at an angle T° from the horizontal H. In various embodiments, the tilt angle is selected based on the classifying application that the system 12 is used for. For example in one embodiment, the tilt angle is equal to or less than 50 degrees from the vertical. In another example embodiment, the tilt angle is substantially 32 degrees from the vertical. However, such angles are merely examples and the tilt angle can vary in various embodiments to achieve desired results for the material being classified.

The scoops 34 each include an outer scoop edge 35 which engages settled material on the bottom of the tanks 30. The scoops 34 are oriented such that the curvature of the scoops 34 opens in the direction of movement of the wheels 32, thus allowing the scoops 34 to scoop material settled on the bottom of the tanks 30. Different shapes of the scoops 34 are possible. In one example embodiment, the scoops 34 are detachable to assist in transportation of the system 12 by lowering its overall height. In such embodiments, the scoops 34 are attached to the inner hub 44 using bolts or other suitable removable fasteners. In other example embodiments, the support bars 52 of the outer hub 50 are divided into sections with a plurality of scoops 34 attached to each section. These sections may then be attached and detached to the inner hub 44 as required, allowing for easier transportation and repair of the system 12. In an example embodiment, the inner hub 44 is narrower than the scoops 34 such that the inner hub 44 is spaced apart from the side wall 54 allowing water to flow off inner edge portions 42 of the scoops 34 that extend beyond the inner hub 44 during rotation of the wheel 32.

As shown in FIG. 9A, in one example embodiment, the bottom wall 55 is perpendicular to the side wall 54, such that the bottom wall 55 is substantially parallel to the outer scoop edge 35 of the scoops 34, and so that settled aggregate material collects in the portion of the tank 30 where the wheel 32 is located. As the wheel 32 rotates upwards with full scoops 34, the scoops 34 rise out of the water with material trapped in the scoops 34 and supported by the side wall 54. As the scoops emerge from the water, water trapped by the scoops 34 flows off and back into the tank 30. As the scoops 34 rotate further, the scooped material undergoes dewatering whereby entrained water is drained from the scooped material. The dewatering continues until the scoops 34 reach the top of the tank 30 and are discharged.

Referring now to FIGS. 1 and 6, the discharge of solid material collected by the system 12 will be described. In the shown embodiment, the discharge chutes 36 of each stage are associated with a corresponding conveyor belt 37 however a single conveyor belt may also be used. The discharge chutes 36 are downwardly oriented towards the conveyor belts 37 to facilitate discharging. Vertical guides 58 may be provided on one or both sides of the discharge chutes 36 direct and channel scooped material toward the lower end of the chutes 36 and onto the corresponding conveyor belts 37. In other embodiments, the discharge chutes 36 may direct scooped material to a single conveyor belt. In some applications, a single conveyor may be used having separate channels for material from each of the classifier stages. In other embodiments, a single conveyor belt may be used for all of the scoop wheels. The use of a common conveyor belt allows scoop material to be recombined to form a mixed aggregate having a particle size/density distribution within product tolerances. For example, in some applications the amount of scooped material from each classifier stage can be selected so that when recombined, the final product has a desired amount of material in each particle size/density range. Using this approach, cleaned and dewatered aggregate having desired characteristics for different applications can be produced.

Figure 22B:
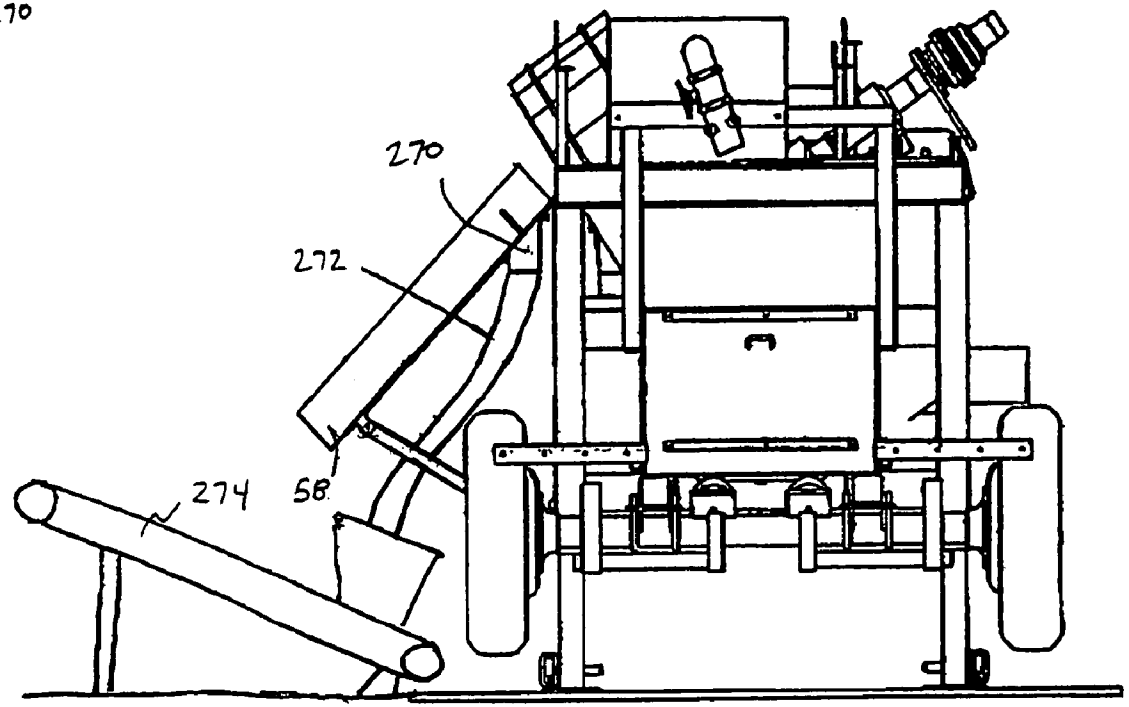
FIG. 22B is an end view of a material classifier having a diverter for scooped material attached to its discharge chute.
Figure 22A:
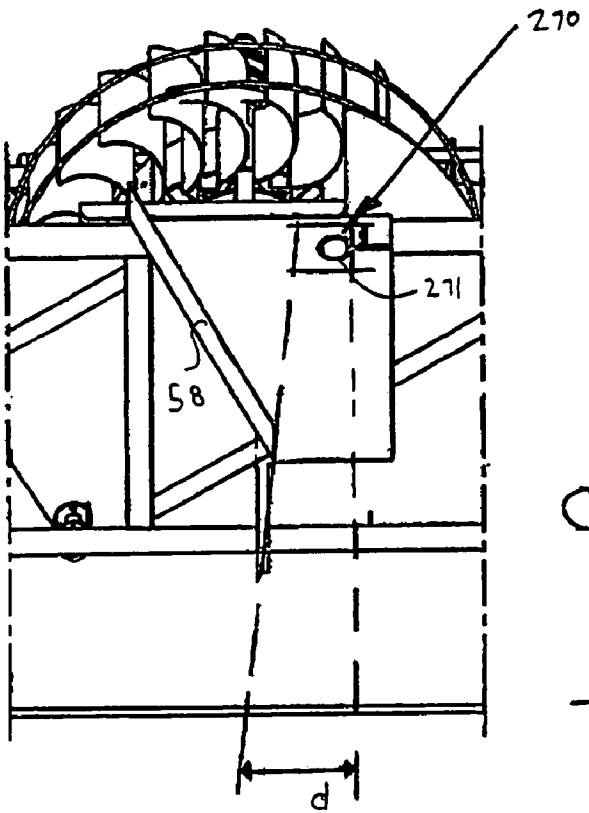
FIG. 22A is a side view of a material classifier having a diverter for scooped material attached to its discharge chute.

As shown in FIGS. 22A and 22B, a portion of the material collected by a scoop wheel may be scalped or removed. In the shown embodiment, the discharge chute 36 includes a diverter 270. The diverter 270 comprises a hollow conduit or tube communicating with an opening 271 in the discharge chute 36 at one end. Flexible tubing 272 may be attached at the other end of the diverter 270. A portion of the scooped material discharged onto the chute 36 falls through the diverter 270 and the tubing 272. The tubing 272 discharges the diverter material onto a conveyor belt 274 for transportation elsewhere, for example, to a separate discharge pile. The trajectory of material avoiding or bypassing the diverter 270 and entering the conveyor belts 37 for collection as part of the final product is represented by the reference "d". The use of a diverter 270 allows the required amount of scooped material collected at a scoop wheel 32 to be obtained by removing or diverting any excess portion in order to meet the specifications of the final product. In other embodiments, a pivotally mount bar or arm may be used rather than a diverter tube. In such cases, the bar may be pivotally mounted to pivot about its centre. The pivotally mounted bar may be, for example, a finger gate. Adjustment of the position of the bar changes the portion of scooped material which is diverted from the main portion of the discharge chute 36 which discharges onto the conveyor belt 37 as part of the final product to increase or decrease the amount of diverted material.

Referring now to FIG. 1 to 4, the operation of an example embodiment of the system 12 will be described in more detail. The direction of movement of the wheels 32 is indicated by reference 56. In this embodiment, the wheels 32 of each classifier 14 rotate in the direction of the mixing box 22. Aggregate material is transported by a conveyor belt (not shown) or other transport means into the mixing box 22. The aggregate material may be pre-screened to remove particles that are larger than the application tolerance such as rocks. Water is continuously fed into the mixing box 22 through an inlet pipe (not shown). The water and aggregate material forms a liquid-solid mixture or pulp that passes through the mixing box 22. The liquid-solid mixture is fed into the tank of the first classifier 14*a*. A gate 40 provides an opening between the tank 30 of the first classifier 14*a* and the tank 30 of the second classifier 14*b* which allows water and suspended material to flow from the first stage to the second stage. Similarly, a gate 40 provides an opening between the tank 30 of the second classifier 14*b* and the tank 30 of the third classifier 14*c* which allows water and suspended material to flow from the second stage to the third stage. A gate 40 may also be provided at a discharge end of the tank 30 of the final stage 14*c*. In other embodiments, an outlet chamber 59 (FIG. 2) is located opposite the mixing box or feed tank 22. Liquid from the third tank overflows a lip or weir in the end wall of the tank and flow into the outlet chamber 59. An opening in the outlet chamber 59 is connected to a flexible hose or tubing which flows out to a tailings pond (not shown).

The gates 40 include a control mechanism that allows the gate opening to be enlarged or contracted by raising or lowering the gates 40. Controlling the size of the gate openings allows the flow rate of water and suspended solids between classifier stages to be controlled, and consequently the water level in each of the tanks 30. In one example embodiment, water flow through the system 12 is regulated such that the water level drops from the first stage to the second stage, and then from the second stage to third stage. In other embodiments, the water level may increase from the first stage to the last stage. Other means for controlling the flow through the system 12 may be used in addition to, or in place of, the gates 40. In some embodiments, the water level in the tanks 30 is also controlled by pumping some of the water from one or more later stages back into earlier stages. The flow of water between the tanks 30 may also be affected by the level of the classification system 12. If the classification system is not level, the water level in each of tanks will be affected by the level of the system.

Although aspects of the present invention can be used for sorting a number of different types of material, for example various types of aggregate and reclaimed solids from sewage or wastewater treatment operations, hereinafter the use of the system 12 as a sand classifier will be described.

Figure 7:
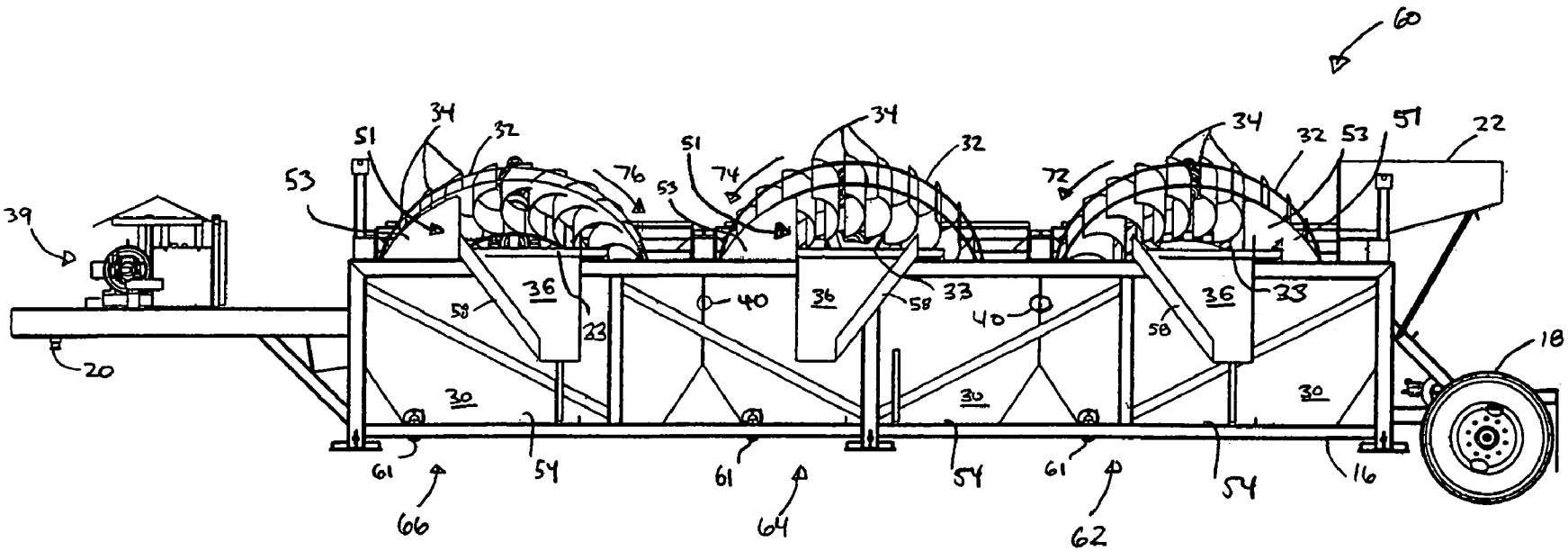
FIG. 7 is a side view of a further material classifier constructed according to another embodiment of the present invention.

In the first stage 14*a* of the classification system, the speed of the wheel 32 is selected so that a desired grade or amount of settled solids are collected in the first stage 14*a*. In some embodiments, the rotation of the wheel 32 contributes to agitation of the water in the tank 30 of the first classifier 14*a* such that sand particles that are generally less than a predefined mass are kept suspended, whereas particles that are generally heavier than the predefined mass sink to the bottom of the tank 30 where they are scooped up by the scoops 34. As the wheel 32 rotates, upward moving scoops 34 emerge from the water. As the scoops 34 emerge, water captured by the scoops 34 is drained off and returned to the tank 30. Some suspended particles are carried back with the water into the tank 30. As the wheel 32 rotates further, the entrained water is drained away from the scooped materials until the scoops 34 reach the discharge opening 51. Once at the discharge opening, the scooped material carried by the scoops 34 slides off and down the discharge chute 36 to a collection device such as a conveyor belt 37 (FIG. 7). Lighter particles that remain suspended in the water of the first stage then travel through the gate 40 and into the tank 30 of the second stage.

In the second stage 14*b*, similar to the first-stage, the wheel 32 turns at a speed such that a desired amount or grade of settled solids are collected in the second stage 14*b*. In some embodiments, the rotation of the wheel 32 contributes to agitation of the water in the tank 30 of the second classifier 14*b* such that particles that are generally below a certain mass are suspended in the water in the tank 30, while particles that are generally heavier than that mass sink to the bottom of the tank 30 where they are scooped up by the scoops 34 of wheel 32 of the second stage. As in the first stage, when the scoops 34 emerge from the water as the wheel 32 rotates, water captured by the scoops 34 is initially drained off and returned to the tank 30. As the wheel 32 rotates further, the entrained water is drained away from the scooped materials until the scoops 34 reach the discharge opening 51. Once at the discharge opening, the scooped material carried by the scoops 34 slides off and down the discharge chute 36 to the conveyor belt 37. Lighter particles that remain suspended in the water of the second stage then travel through the next gate 40 and into the tank 30 of the third stage.

In the third stage 14*c*, very fine particles or silt is removed. The wheel 32 of the third classifier 14*c* moves at a speed slow enough that at least some of the silt particles can settle on the bottom of the tank 30, where they are scooped up by the scoops 34 of the wheel 32 and deposited on the discharge chute 36 of the third stage. Water leaves the third stage by the final gate 40 (FIG. 9A) and is sent to a tailings pond (not shown). This water contains residual suspended solids that did not settle on the bottom of the tank 30 of the third stage. The rate of rotation of the wheel 32 in the third stage 14*c* is selected so that a predetermined percentage of silt particles are removed. In one embodiment, the speed of the wheel 32 is selected to obtain 20 percent recovery of silt particles. Recovery of silt particles reduces the need for and cost associated of recovering silt from the tailings pond.

In other embodiments, finer particles are removed from the third classifier stage while most silt particles, for example particles having a particular diameter of less than 400 μm, remain in suspension. The silt particles exit the classifier system as overflow and are sent to tailings pond.

It will thus be appreciated that in this example embodiment, sand passing through the system 12 is cleaned, classified into different sizes, and at least partially dewatered. The range of sizes extracted at each stage depending upon a number of variables including, for example, the rate at which the aggregate material and water is fed into the system 12, the agitation occurring in the mixing box 22, the distance from the mixing box 22, the rates at which the wheels 32 rotate, the size and number of scoops 34 on the wheels 32, and the location and size of the gate openings between stages.

A programmable logic controller (PLC) or other suitable controller may be used to improve process control in relation to the rate which the aggregate material is fed to system 12, the rate that water is fed to system 12, the rate of rotation of the wheels 32, and possibly the size of the gate openings between the stages.

Variations of the system 12 will now be described. In one embodiment, the wheel 32 in the first stage rotates between 8 and 12 rpm, the wheel 32 in the second stage rotates between 4 and 6 rpm, and the wheel 32 in the third stage rotates at less than 4 rpm. Such speeds are provided merely as non-limiting examples and other speeds for the wheels 32 are possible with desired wheel speed depending upon, among other things, wheel size, tank size, the number and size of scoops, the tilt angle and the material being classified. Further, the speed at which each of the wheels 32 rotates is a selectable parameter and need not decrease between successive stages as in the present embodiment. In some embodiments, each wheel 32 rotates at the same speed.

Wheel speed, wheel size, the number of scoops, scoop size, shape and spacing, title angle, tank size, gate size and opening, among other things, are parameters that can vary in different embodiments of the invention, and can vary between the classifier stages in some embodiments, in order to achieve desired results for the material being classified. For example, in some embodiments, the wheel 32 in the third stage has narrower scoops 34 than the wheels 32 in the first and second stages. Shorter scoops 34 may be used in the third stage because the volume of aggregate material removed in this stage is smaller compared to the first and second stages where the bulk of the material is removed.

Generally, the wheel speed is set to rotate as quickly as possible, but slow enough to allow at least some dewatering to occur. If the wheel speed is set too high, too much water will be retained by the scooped material and, in some cases, water trapped by the scoops 34 may not drain off and will be scooped out of the tanks 30 with the discharged material. The number of scoops 34 per wheel is set such that the wheel 32 is filled, however the scoops 34 cannot be packed so tightly that the operation or one scoop 34 interferes with the operation of the adjacent scoops 34. The length of the scoops 34 is typically set to achieve a certain tons per hour capacity. Wheel diameter is typically as large as possible to increase capacity, but small enough for the system 12 to be transported (for example in a freight container), and small enough to be manageably setup by the end user.

In the embodiment shown in FIG. 1 to 4, the system 12 is supported by the common frame 16 which has wheels 18 at one end thereof, and a hitch 20 at the opposite end thereof so that the classifier can be easily moved, for example, by towing the system 12 using a freight truck. In one non-limiting example embodiment, the system 12 is sized to be easily transported in a standard freight container (for example, a container having approximate interior dimensions of 7'-6"×39'-6"). In such cases, the system can be transported as a normal legal load without special load constraints. In other embodiments, the system has a stationary configuration and is not readily portable. In yet other embodiments, the classifiers 14 are separate units that do not share a common frame.

Reference is now made to FIG. 7, which shows a further example embodiment of a system 60 for classifying a liquid-solid mixture implemented according to the present invention. The system 60 is similar to the system 12, except that the orientation of the wheels 32 is different. The system 60 comprises three material classifiers indicated individually by references 62, 64 and 66. The first and second classifiers 62 and 64 rotate in the direction of the hitch 20 i.e. in a downstream direction, whereas the third classifier 66 rotates in the opposite direction towards the mixing box 22 i.e. in an upstream direction. The direction of movement of the wheels 32 is indicated individually by references 72, 74, and 76 (FIG. 7). As with the system 12, the scoops 34 are curved in the direction of movement of the wheels 32 to scoop the material settled on the bottom of the tanks 30. In yet other embodiments, the first and second classifiers rotate towards the mixing box 22 and the third classifier rotates away from the mixing box 22.

Figure 8:
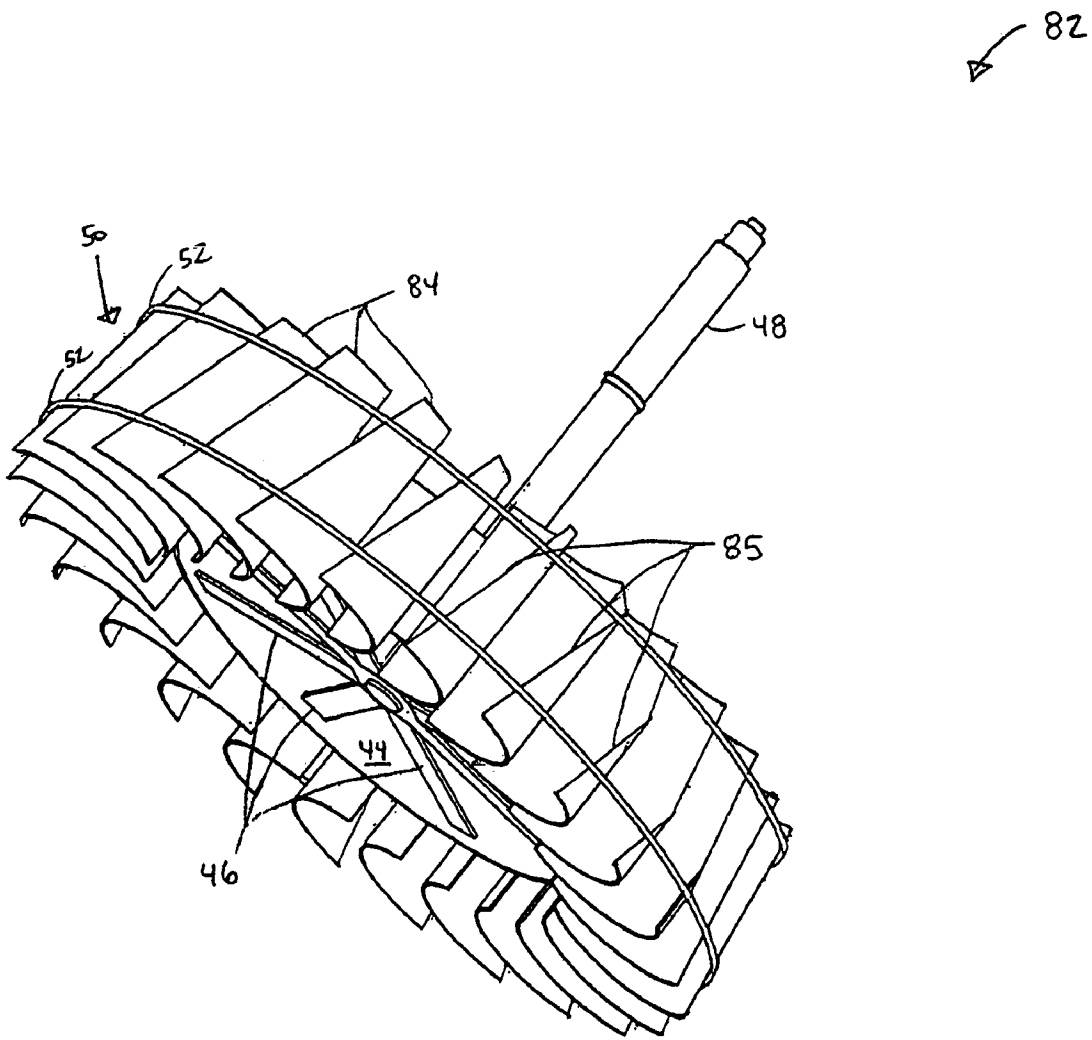
FIG. 8 is a perspective view of an alternate embodiment of a scoop wheel for a material classifier.
Figure 9B:
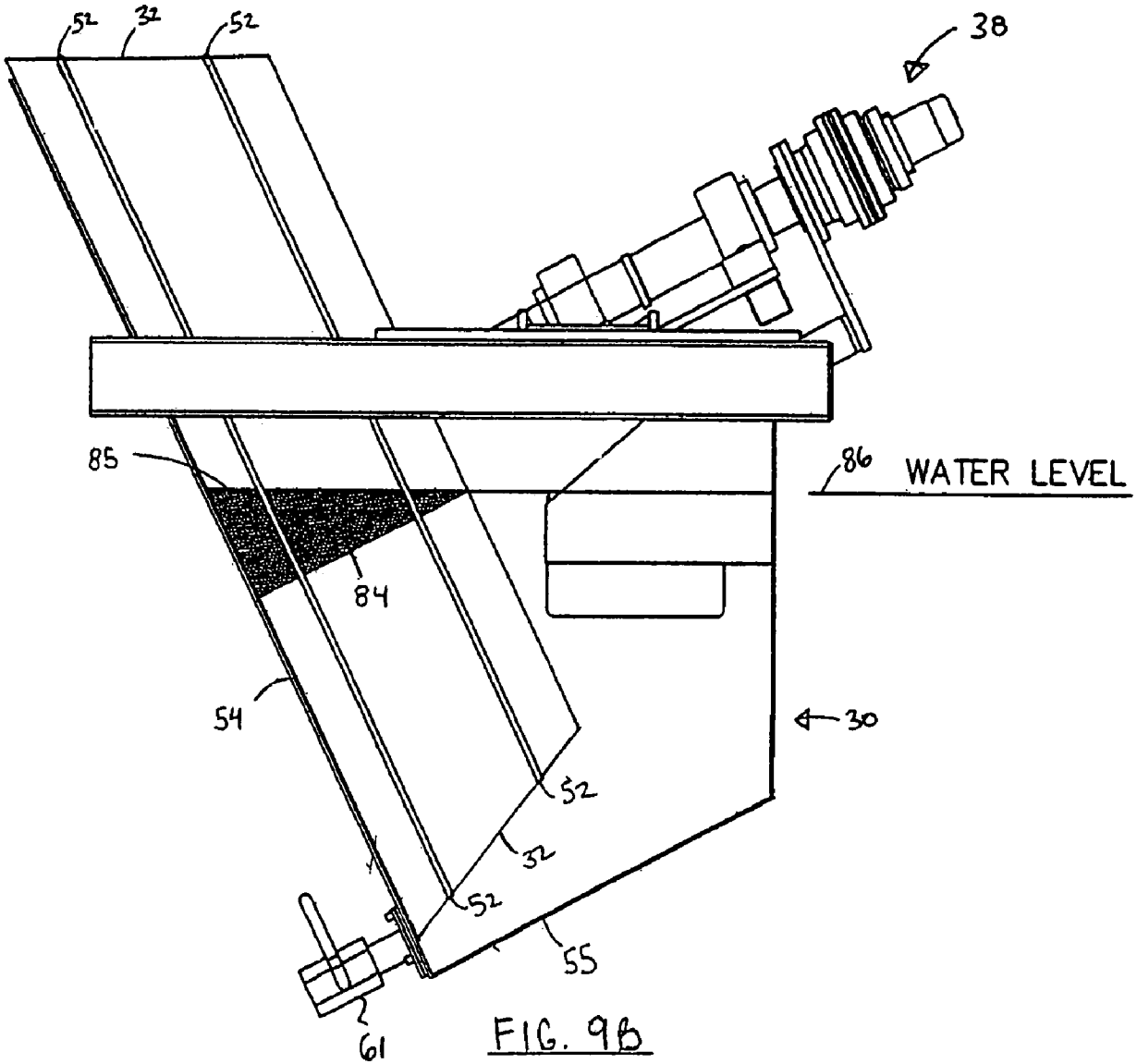
FIG. 9B is a sectional end view of a material classifier having the scoop wheel of FIG. 8 showing the water line in the tank during operation.

Reference is now made to FIGS. 8 and 9B, which show another embodiment of a material classifier 80 according to the present invention. The material classifier 80 is similar to the material classifier 14, with the exception that the shape of the scoops attached to the scoop wheels is different. Each material classifier 80 comprises a tank or hopper 30 having a side wall 54, and an angularly mounted wheel 82 having a plurality of radially extending, curved scoops or lifts 84. Each scoop 84 has an outer scoop edge 85 which engages settled material on the bottom of the tanks 30. As before, the wheels 82 and their corresponding scoops 84 serve the dual purpose of agitating the contents of each of the tanks 30, and scooping material out of the tanks 30 and depositing it on discharge ramps or chutes 36.

Similar to the scoops 34 of the system 12, the scoops 84 are curved in the direction of movement of the wheels 82 to scoop the material settled on the bottom of the tanks 30. However, the scoops 84 are tapered away from the side wall 54 such that the outer scoop edge 85 is substantially parallel to the surface of the water in the tank 30. In this manner, the taper of each scoop 84 corresponds to the tilt angle at which the wheels 82 are mounted within the tanks 30. Tapering of the scoops 84 provides improved ejection of the water carried by the scoops 84 when they emerge from the water during the discharge operation.

Referring now to FIGS. 9A and 9B, the tapering of the scoops 84 will be explained in more detail. FIG. 9A illustrates a wheel 32 of a material classifier 14 with a liquid-solid mixture such as sand and water received therein. The water line in the tank 30 is indicated by reference 86. For convenience, only one scoop 34 is shown. Similarly, FIG. 9B illustrates a wheel 82 of the material classifier 80 with a liquid-solid mixture such as sand and water received therein. The water line in the tank 30 is indicated by reference 86.

Referring now to FIG. 9A, it will be appreciated that as the wheel 32 emerges from the water at the water line 86, the entire outer scoop edge 35 of the scoop 34 does not emerge from the water at one time, rather an upper portion 88 of the scoop 34 emerges first. Referring now to FIG. 9B, it will be appreciated that tapering allows the entire outer scoop edge 85 of the scoop 84 to emerge from the water at one time, thus allowing captured water to be ejected evenly from the scoops 84 from both sides thereof.

Other variations of the material classifier are also possible. Instead of using separate tanks for each wheel 32, a single large tank could be used to house all the wheels 32. Minor adjustments to the classifier may be required in the single tank configuration, for example, partitions or baffles may be needed to provide some separation between the classifier stages. In this embodiment, lighter particles held in suspension are allowed to flow to the far end of the tank nearest the last wheel 32. In other embodiments, more or few classifier stages are used, for example, in one example embodiment only two classifier stages are used with the overflow from the second stage containing very fine particles or silt, which is sent to a tailings pond. In still other example embodiments, only a single classifier stage and wheel is used. In another example embodiment, multiple classifier stages are used, with the wheels 32 operating at different speeds, but the tilt angle is substantially 0° from the vertical V, the wheels being serially offset to allow for material discharge. For example, three vertically oriented material classifiers may be used in series.

It will be appreciated by one of skill in the art that in some embodiments of the present invention, the wheels 32 are offset to one side from the flow of the classifying stream, i.e. the flow of the liquid-solid mixture, through the system 12 such that in each tank, the classifying stream can flow from the inlet at the mixing box to the outlet at the opposite end of the classification system past the offset scoop wheels. Offsetting of the wheels 32 can partially or completely isolate or separate the wheels 32 from the classifying stream, depending on the specific embodiment. In such cases, rotation of the wheels 32 contributes very little, if at all, to the agitation of the classifying stream, and the distance from the mixing box 22 becomes one of the dominant factors which affect the settling rate and size of settled particles in a particular stage when other variables remain constant. In these embodiments, the classification system may include a longitudinally extending partition defining an inlet channel for receiving the liquid-solid mixture to further isolate the scoop wheels 32 from the classifying stream. The longitudinal partition may be disposed opposite the scoop wheels, and may be aligned with the side wall 54 and/or the inner side of the scoop wheels 32. In some embodiments, the longitudinal partition extends substantially parallel to the side wall 54. In some applications, the liquid solid-mixture may be introduced into the inlet channel at high flow rate. In such applications, the inlet channel is relatively turbulent while the liquid-solid mixture surrounding the scoop wheels is relatively calm facilitate settling.

Figure 10:
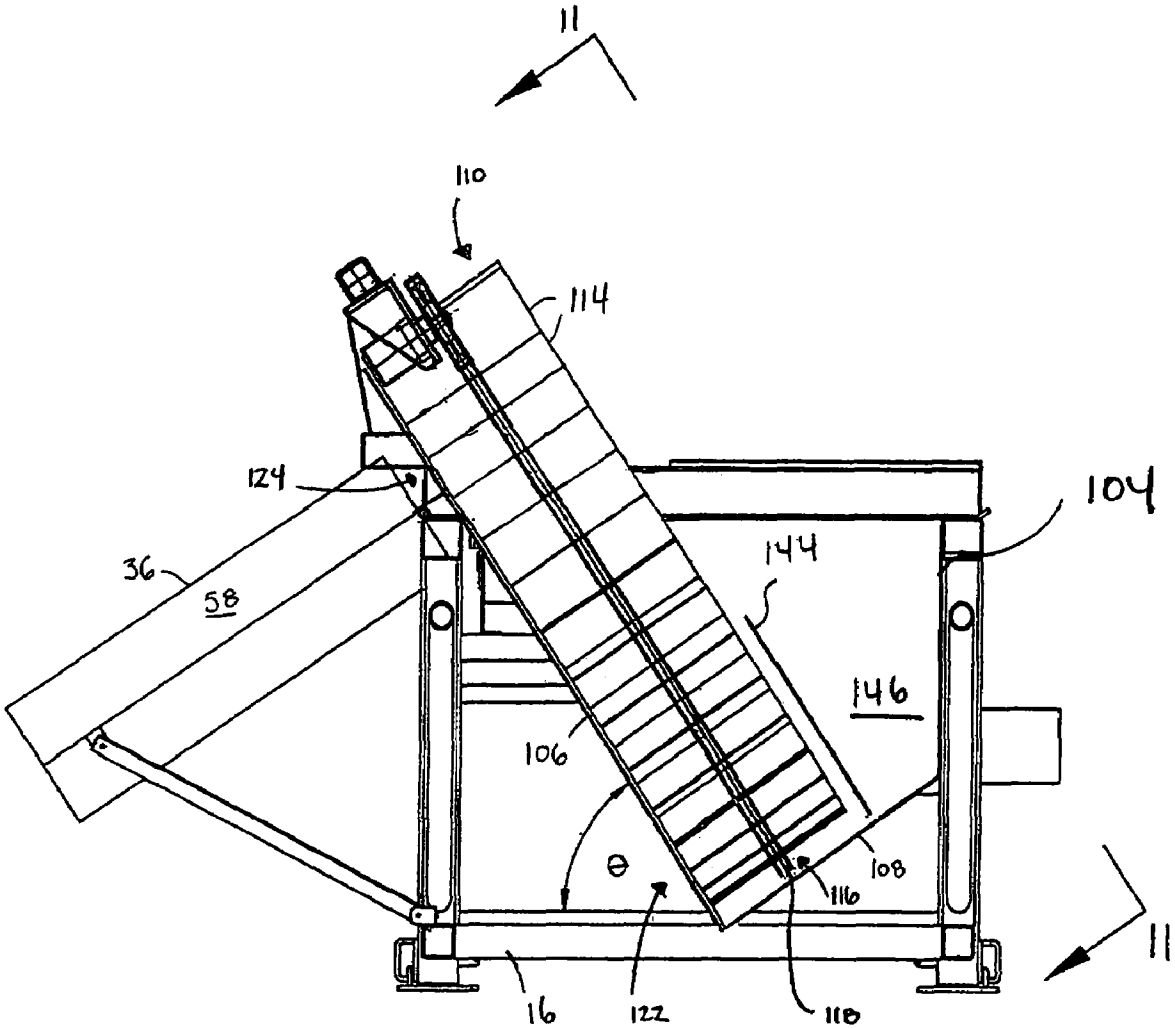
FIG. 10 is a sectional end view of another embodiment of a material classifier constructed according to the present invention.
Figure 11:
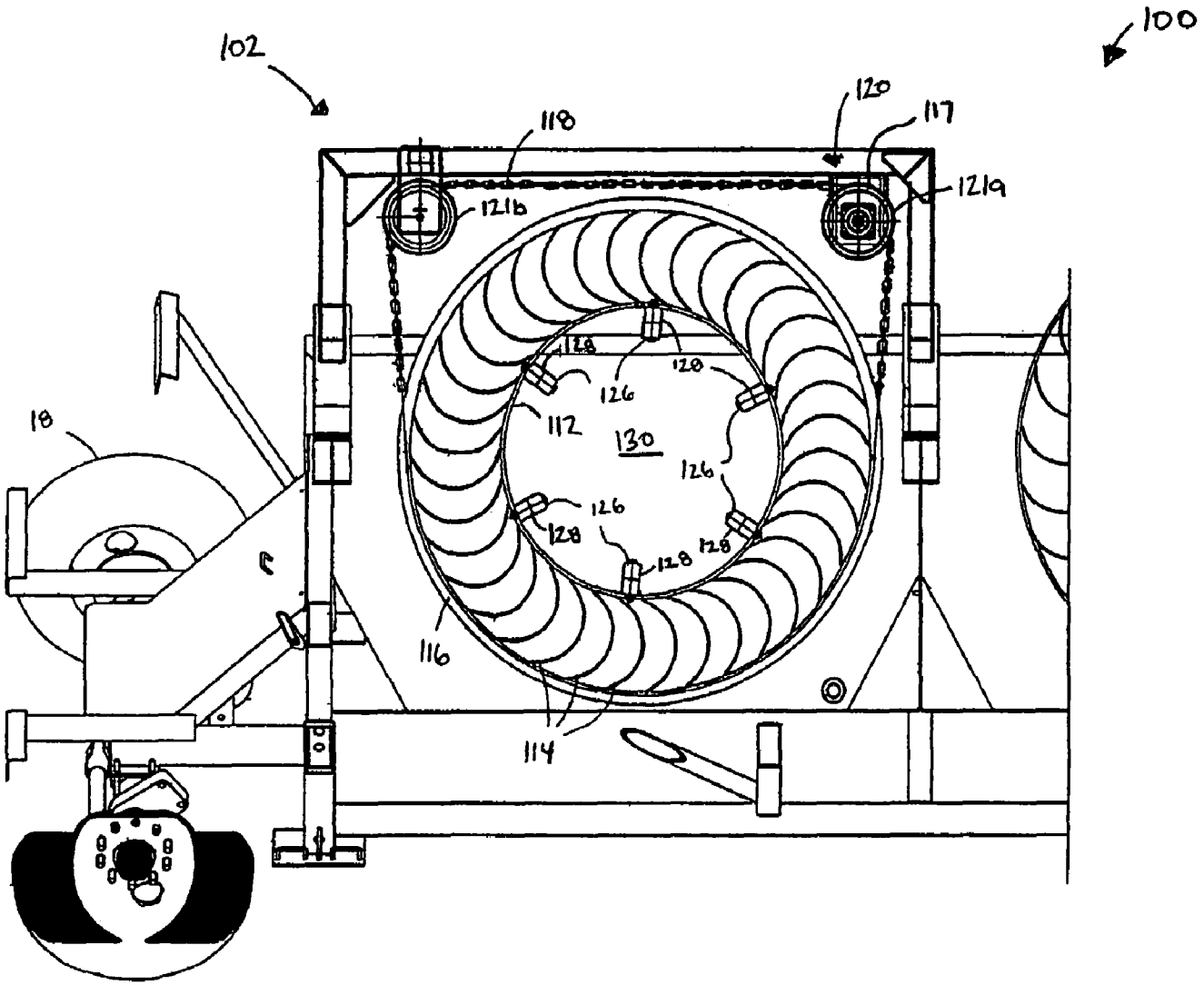
FIG. 11 is a sectional view of the scoop wheel of FIG. 10 taken along the line 11-11.

Referring now to FIGS. 10 and 11, another embodiment of a classification system 100 for classifying a liquid-solid mixture according to the present invention will be described. The system 100 is similar in operation and function to the previously described systems 12 and 60, except that the system 100 uses a suspended drive system to rotate the scoop wheel rather than a drive system implemented using a drive shaft as used in the systems 12 and 60. The system 100 includes one or more material classifiers 102 for classifying a liquid-solid mixture containing solid material to be separated. The material classifier 102 includes a tank 104 having a side wall 106 and bottom wall 108 defining a reservoir for receiving the liquid-solid mixture. The side wall 106 is positioned at an angle θ relative to a horizontal reference (e.g. base of the support frame 16). A wheel 110 is suspended at least partially within the tank 104 to rotate about a wheel axis perpendicular to the side wall 106. In some example embodiments, the angle θ of the side wall 106 relative to the horizontal reference is greater than 30 degrees and less than 90 degrees. In other embodiments, the angle θ of the side wall 106 relative to the horizontal reference is greater than 40 degrees and less than 70 degrees, and in some embodiments, the angle θ of the side wall 106 relative to the horizontal reference is greater than 50 degrees and less than 60 degrees. In one example embodiment, the angle θ of the side wall 106 relative to the horizontal reference is approximately 56 degrees. The above examples are merely illustrative and other angles may be employed in different embodiments.

The wheel 110 includes an inner hub 112 and a plurality of spaced apart scoops 114 extending radially from the inner hub 112 for scooping solid material which has settled on the bottom wall 108 and subsequently discharging the scooped solid material from the tank 104 during rotation of the wheel 110 about its wheel axis. The inner hub 112 may comprise a substantially cylindrical wall or ring from which the scoops extend, at least some of the scoops having a width greater than that of the cylindrical wall. However, in other embodiments the inner hub 112 may comprise two or more spaced apart concentric rings inset from respective end edges of the scoops 114. The wheel 110 is suspended in the tank 104 and driven by a drive belt 118. The wheel 110 may also includes a circumferential guide or track 116 for cooperating with the drive belt 118 for rotating the scoop wheel 110 about its wheel axis, the guide 116 being provided around an outer circumference of the scoop wheel 110. As will be appreciated by one of skill in the art, the wheel 110 is not rigidly mounted. The suspension of the wheel 110 from the drive belt 118 permits the wheel axis to float about a plane substantially perpendicular to the wheel axis, for example, the wheel 110 may float about the side wall 106.

As shown in FIGS. 10 and 13, in one example embodiment the guide 116 has a U-shaped cross-section for receiving the drive belt 118. The guide 116 may, in some embodiments, have an L-shaped cross-section (FIG. 14) and be formed from angle iron. In the present embodiment, the guide 116 provides a smooth track for the drive belt 118 to ride on, however teeth for engaging the drive belt 118 may also be provided if desired. The guide 116 may be used in addition to, or in place of, an outer hub 50 comprising concentric support bars 52 described earlier. In one example embodiment, the guide 116 comprises a flat rail mounted around the outer circumference of the wheel 110 with a pair of spaced apart concentric bars attached to the outer surface of the flat rail. The support rails are spaced apart so that the drive belt 118 is at least partially received within the guide 116. A drive 120 is provided for driving the drive belt 118 to rotate the wheel 110 within the tank 104. The drive 120 engages and drives the drive belt 118 so as to rotate the wheel 110 about its wheel axis. Discharge chutes 36 for each wheel 110 collect the discharged solid material and direct it onto a corresponding conveyor belt (not shown) where it will be transported elsewhere, for example to a discharge pile for open storage.

The drive belt 118 may be a drive chain, cable, web, belt, twisted cable or similar means. In some embodiments, the drive belt 118 includes a drive chain and the drive 120 comprises a driven sprocket wheel 121*a* and a passive sprocket wheel 121*b*. The driven sprocket 121*a* may be driven by a motor 117. The driven sprocket wheel 121*a* and passive sprocket wheel 121*b* are laterally offset from one another at a distance greater than the outer diameter of the wheel 110 and located higher than the wheel axis so as to allow the wheel 110 to be suspended between them. The passive sprocket 121*b* does not drive the drive chain, but allows the chain to pass over it as it is pulled by the driven sprocket 121*a*. In other embodiments where the drive belt is a cable or belt, the drive may comprise a driven wheel or roller and a passive (guide) roller, e.g. pulley, for passively allowing the drive cable or belt to pass over it.

The side wall 106 includes a lower portion 122 opposite the wheel 110 for impeding scooped solid material from discharging from the scoops 114 while rotating inside the tank 104, and an upper portion 124 over which the scoops 114 discharge the scooped solid material. The upper portion 124 includes a guard plate 53 and defines a discharge area or opening 51 adjacent to the guard plate 53. The discharge chutes are attached to an outer surface of the side wall 106 each of the tank 104 at an upper edge 33 of the side wall 106 in communication with the discharge opening 51. The scoops 114 discharge the scooped solid material when rotated higher than the discharge opening 51. In the shown embodiment, the bottom wall 108 is substantially perpendicular to the side wall 106. As shown in FIG. 10, the classifier may also include a longitudinally extending partition 144 defining an inlet channel 146 for receiving the liquid-solid mixture and to assist in isolating the scoop wheels 110 from the classifying stream. The longitudinal partition 144 may be disposed opposite the scoop wheels 110, and may be aligned with the side wall 106 and/or the inner side of the scoop wheel 110*s*. In some embodiments, the longitudinal partition 144 extends substantially parallel to the side wall 106. The longitudinal partition 144 does not extend to the bottom of the classification system allowing the liquid-solid mixture to enter and fill the tanks 104 by passing underneath it. The longitudinal partition 144 may also define openings along its length to allow the liquid-solid mixture to pass therethrough. In some embodiments, the system uses a central tank rather than separate tanks for each scoop wheel. In these embodiments, lateral partitions or baffles (not shown) may be located between the scoop wheels. In some applications, the liquid solid-mixture may be introduced into the inlet channel at high flow rate. In such applications, the inlet channel is relatively turbulent while the liquid-solid mixture surrounding the scoop wheels is relatively calm facilitate settling.

As shown in FIG. 11, the material classifier 102 in an example embodiment includes a plurality of spaced apart rollers 126 rotatably mounted at one end thereof to the inner hub 112 of the wheel 110 and extending radially inward therefrom. The rollers 126 extend radially inward from the inner hub 112 and are positioned for rolling on the side wall 106 during rotation of the wheel 110 about its wheel axis. Each roller 126 has a roller surface 128 for rolling on the side wall 106. The roller surface 128 may be made of a material having a low frictional resistance. In some embodiments, the rollers 126 are urethane bearing rollers. The rollers 126 are mounted so as to maintain a first operating distance between the wheel 110 and the side wall 106. In some embodiments, the first operating distance may be, for example, approximately ¼ inch, however other distances are used in other embodiments. The side wall 106 is substantially planar and includes a central bearing portion having a bearing surface upon which the rollers 126 are positioned for rolling. The rollers 126 and bearing surface 130 reduce the friction associated with the rotation of the wheel 110.

The wheel 110 is suspended from the drive 120 so as to maintain a second operating distance between the wheel 110 and the bottom wall 108 which may be, for example, only approximately 1 inch. Suspension of the wheel 110 from the drive 120 allows the wheel 110 to float relative to the side wall 106 as the wheel 110 is rotated about its wheel axis thereby reducing the opportunity for obstructing material to become jammed between the wheel 110 and side wall 106. The first operating distance created by the rollers 126 being disposed against the bearing surface 130 ensures that the wheel 110 does not ride directly on the side wall 106 as it rotates, thereby reducing the friction that would otherwise occur. The rollers 126 and bearing surface 130 also reduce the frictional resistance and work required to rotate the wheel 110 about its wheel axis.

Figure 12:
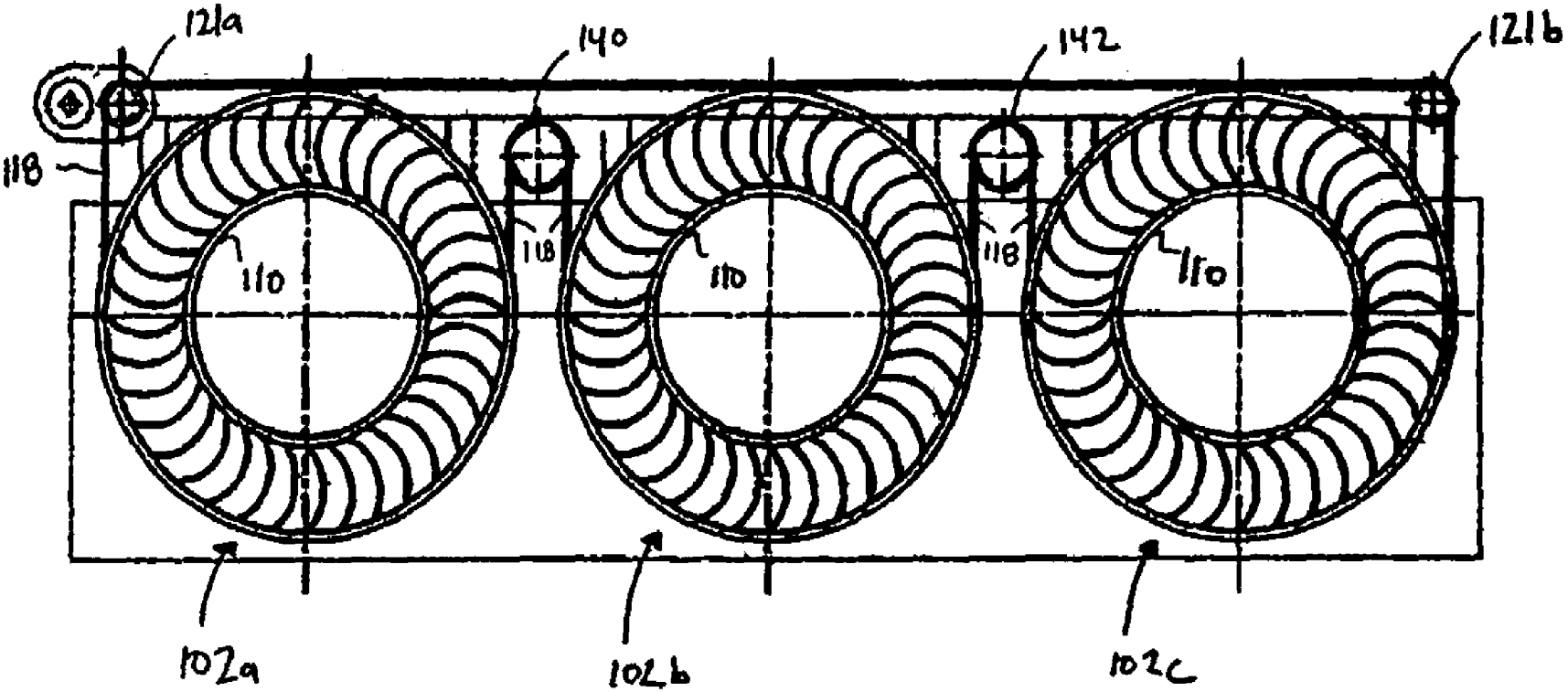
FIG. 12 is a schematic diagram of a classification system constructed according to an embodiment present invention having three scoop wheels and a suspended drive system.

FIG. 12 shows a classification system having three material classifiers 102, indicated individually by references 102*a*, 102*b*, and 102*c*. The three material classifiers 102 are located between a driven sprocket 121*a* at one end and a passive sprocket 121*b* at the other end. A passive sprocket 140 is disposed between the first material classifier 102*a* and second material classifiers 102*b*. A passive sprocket 142 is disposed between the second material classifier 102*b* and third material classifiers 102*c*. Although the driven sprocket 121*a* and a passive sprocket 121*b* are disposed above the material classifiers 102, the passive sprockets 140 and 142 need not be disposed above the classifiers 102. In the shown embodiment, a single driven sprocket 121*a* is used to drive a plurality of scoop wheels 110 with passive sprockets 140, 142 or other guide means interposed therebetween. In other embodiments, each material classifier 102 may have its own drive belt 118 and drive 120. In such cases, each wheel 110 is independently controllable and can be independently driven.

Process parameters and operating conditions similar to those described above in relation to the systems 12 and 60, for example the direction and rates of rotation of the scoop wheels, may also be applied to the system 100. In some applications, suspension of the scoop wheel 110 can provide improved performance, for example, with trouble material that is prone to clumping. Suspending the wheel 110 within the tank 104 rather than fixing the wheel may reduce the chance of material binding or becoming caught between the scoops 114 and the side wall 106 because the wheel 110 can float over any obstructions on the side wall 106 as it rotates. Further, because the wheel 110 is not rigidly mounted, the wheel axis is permitted to float about a plane substantially perpendicular to the wheel axis, for example on the side wall 106. The use of a drive belt 118 may also reduce the work required to rotate the wheel 110 by creating a larger reduction ratio as compared to using a drive shaft. Thus, the wheel 110 is relatively easy to drive and apply torque to and allows a smaller drive motor to be used. In some embodiments, a reduction ratio of 7:1 may be utilized.

The system 100 may be coupled to a PLC or other suitable controller as described above with reference to the systems 12 and 60. Typically, a pressure load cell or strain gauge (not shown) measures the load applied to the wheel 110 and transmits this information to the PLC. The PLC then adjusts the rate of rotation of the wheel 110 so as to increase to the rate of rotation as the load increases and decease the rate of rotation as the load decreases. In this way, improved classification and dewatering of the solid material may be achieved. Other factors may also be monitored and controlled by the PLC to improve control of the classification process.

Referring now to FIG. 15 to 19, and 21 another embodiment of a system 200 for classifying a liquid-solid mixture according to the present invention will be described. The system 200 has a suspended drive system similar to the previously described system 100. The system 200 includes one or more material classifiers 202 for classifying a liquid-solid mixture containing solid material to be separated. The material classifier 202 includes a tank 204 having a side wall 206 and bottom wall 208 defining a reservoir for receiving the liquid-solid mixture. The side wall 206 is positioned at an angle θ0 relative to a horizontal reference (e.g. base of the support frame 16). A wheel 210 is suspended at least partially within the tank 204 to rotate about a wheel axis perpendicular to the side wall 206. In some example embodiments, the angle θ of the side wall 206 relative to the horizontal reference is greater than 30 degrees and less than 90 degrees. In other embodiments, the angle θ of the side wall 206 relative to the horizontal reference is greater than 40 degrees and less than 70 degrees, and in some embodiments, the angle θ of the side wall 206 relative to the horizontal reference is greater than 50 degrees and less than 60 degrees. In one example embodiment, the angle θ of the side wall 206 relative to the horizontal reference is approximately 56 degrees. The above examples are merely illustrative and other angles may be employed in different embodiments.

The wheel 210 includes an inner hub 212 and a plurality of spaced apart scoops 214 extending radially from the inner hub 212 for scooping solid material which has settled on the bottom wall 208 and subsequently discharging the scooped solid material from the tank 204 during rotation of the wheel 210 about its wheel axis. As shown in FIG. 15-17, 19 and 21, the inner hub 212 may comprise two or more spaced apart concentric rings 213 inset from respective end edges of the scoops 214. However, in other embodiments the inner hub 212 may comprise a substantially cylindrical wall or ring from which the scoops extend, at least some of the scoops having a width greater than that of the cylindrical wall. The wheel 210 is suspended in the tank 204 and driven by a drive belt 218. The suspension of the wheel 210 from the drive belt 218 permits the wheel axis to float about a plane substantially perpendicular to the wheel axis, for example, the wheel 210 may float about the side wall 206. The wheel 210 may also includes a circumferential guide or track 216 for cooperating with the drive belt 218 for rotating the scoop wheel 210 about its wheel axis. The guide 216 is provided around an outer circumference of the scoop wheel 210. The guide 216 may be similar to the guide 116 described earlier.

The drive belt 218 is at least partially received within the guide 216. A drive 220 is provided for driving the belt 218 to rotate the wheel 210 within the tank 204. The drive 220 engages and drives the drive belt 218 so as to rotate the wheel 210 about its wheel axis. Discharge chutes (not shown) for each wheel 210 collect the discharged solid material and direct it onto a corresponding conveyor belt (not shown) where it will be transported elsewhere, for example to a discharge pile for open storage. The drive belt 218 and drive 220 may be similar to the drive belt 118 and drive 120 described earlier.

The wheel 210 is suspended from the drive belt 218 so as to maintain an operating distance between the wheel 210 and the bottom wall 208. Suspension of the wheel 210 from the drive allows the wheel 210 to float relative to the side wall 206 as the wheel 210 is rotated about its wheel axis thereby reducing the opportunity for obstructing material to become jammed between the wheel 210 and side wall 206.

Figure 16:
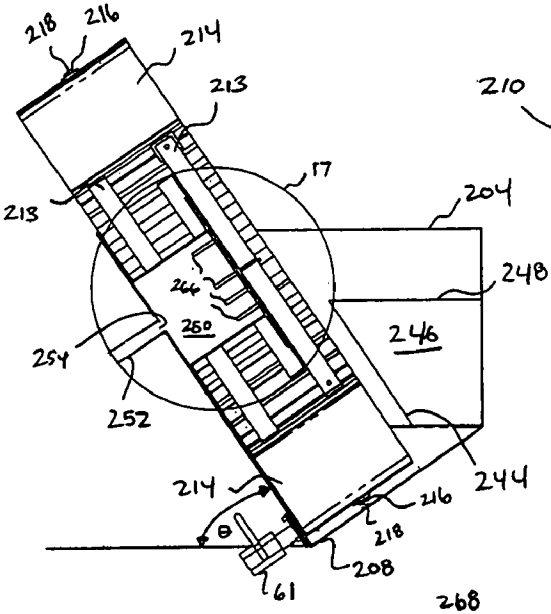
FIG. 16 is a sectional view of the scoop wheel of FIG. 15 taken along the line 16-16.
Figure 17:
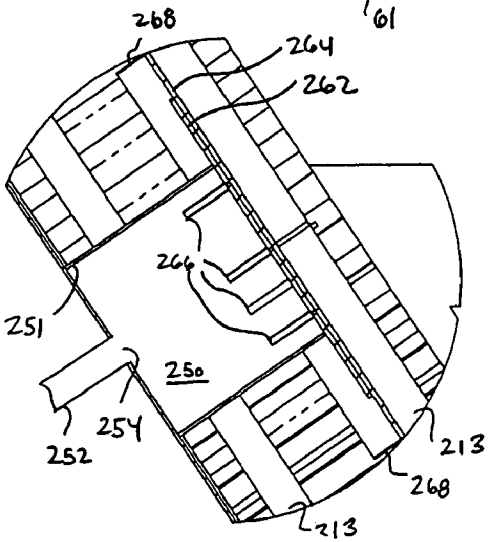
FIG. 17 is an enlarged view of a section of the scoop wheel of FIG. 16 indicated by the reference 17.
Figure 18:
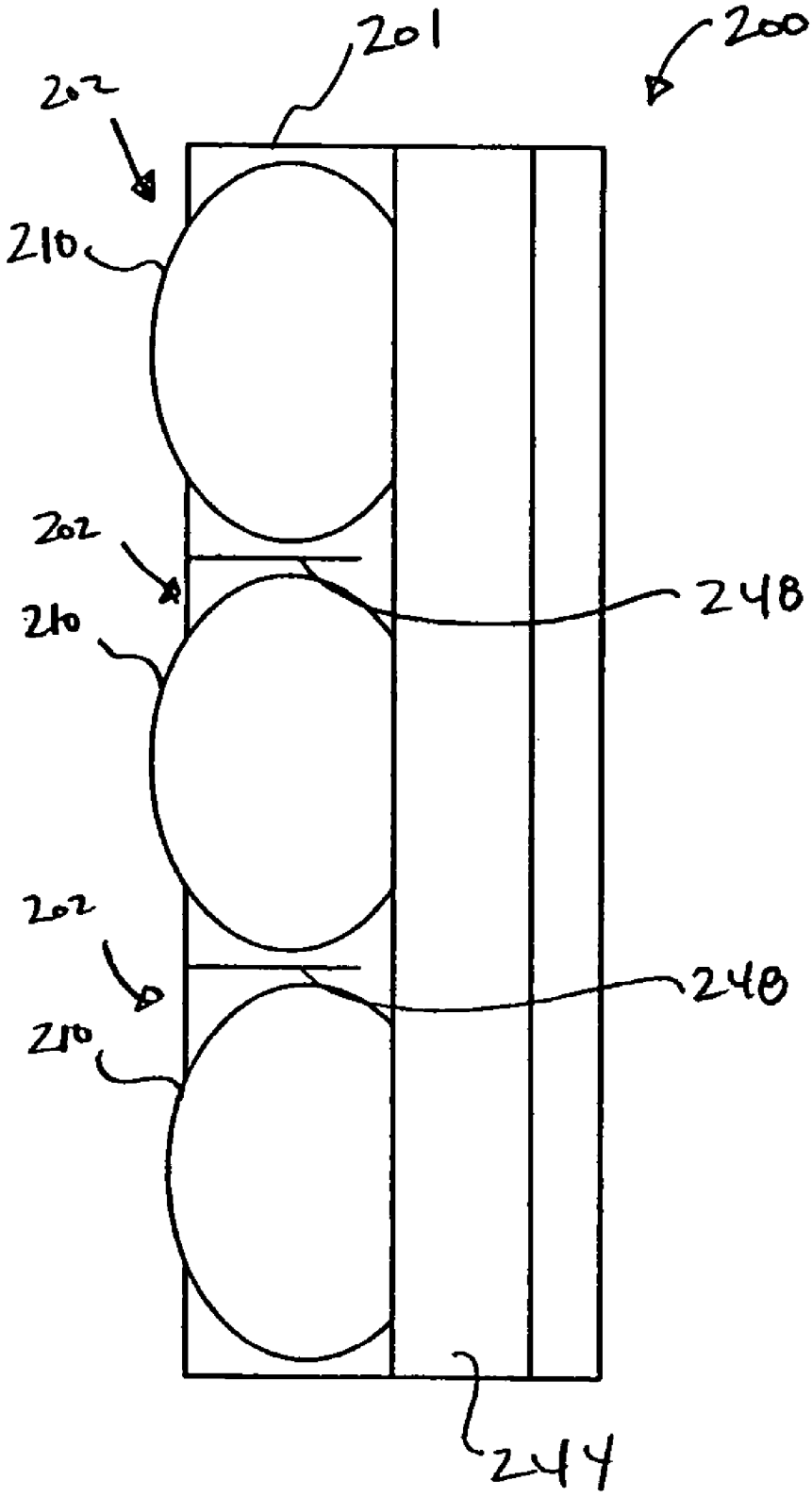
FIG. 18 is a schematic diagram of a material classifier according to one embodiment of the present invention.

The side wall 206 includes a lower portion 222 opposite the wheel 210 for impeding scooped solid material from discharging from the scoops 214 while rotating inside the tank 204, and an upper portion 224 over which the scoops 214 discharge the scooped solid material. The upper portion 224 defines a discharge area or opening 51 through which scooped solid material is discharged. The upper portion 224 may also include a guard plate 53 which impedes scooped solid material from discharging from the scoops 214 before reaching the discharge opening 51 on the upper portion of the scoop rotation. The discharge chutes are attached to an outer surface of the side wall 206 each of the tanks 204 at an upper edge 33 of the side wall 206 in communication with the discharge opening 51. The scoops 214 discharge the scooped solid material when rotated higher than the discharge opening 51. In the shown embodiment, the bottom wall 208 is substantially perpendicular to the side wall 206. As shown in FIGS. 16 and 18, the material classifier 202 may also include a longitudinally extending partition 244 defining an inlet channel 246 for receiving the liquid-solid mixture and to assist in isolating the scoop wheels 210 from the classifying stream. The longitudinal partition 244 may be disposed opposite the scoop wheel 210, and may be aligned with the side wall 206 and/or the inner side of the scoop wheel 210. In some embodiments, the longitudinal partition 244 extends substantially parallel to the side wall 206. The longitudinal partition 244 does not extend to the bottom of the classification system allowing the liquid-solid mixture to enter and fill the tanks 204 by passing underneath it. The longitudinal partition 244 may also define openings along its length to allow the liquid-solid mixture to pass therethrough. As shown in FIG. 18, the classification system 200 may include an elongate central tank 201 rather than separate tanks for each scoop wheel 210. In these embodiments, lateral partitions or baffles 248 may be located between the scoop wheels. The lateral partitions 248 extend partially across the central tank 201 and define the tanks 204 of the respective scoop wheels. The lateral partitions 248 are spaced apart to define the tanks 204 in a series extending from a mixing box 22 at one end to an outlet at an opposite side thereof. The outlet may be located within an outlet chamber located opposite the mixing box 22. In some embodiments, liquid from the tank 201 overflows a lip or weir in the end wall of the tank and flow into the outlet chamber. An opening in the outlet chamber is connected to a flexible hose or tubing which flows out to a tailings pond (not shown).

As shown in FIG. 18, the scoop wheels 210 are offset from the inlet channel 246 at least partially isolating the scoop wheels 210 from the classifying stream. In such applications, the distance from the mixing box 22 becomes one of the dominant factors which affect the settling rate of the solid material. In some applications, the liquid solid-mixture to be separated may be introduced into the inlet channel 246 at high flow rate. In such applications, the inlet channel is relatively turbulent while the liquid-solid mixture surrounding the scoop wheels is relatively calm facilitate settling.

As will be appreciated by one of skill in the art, the particular characteristics of the starting aggregate fed into the mixing box 22 may vary. As a result, determination of the process parameters that are required to obtain the necessary separation at each stage typically requires adjustment between different batches of material to be separated. Adjustment of the wheel speed allows the operator to affect the particle size/density or grade of material collected at each scoop wheel 210. For new batches of material to be classified, the operator may collect a sample of the material discharged by the scoop wheels 210. The sample then undergoes testing to determine the particle size distribution using sieve trays other suitable testing methodology. Based the particle size distribution, the wheel speed of one or more of the scoop wheels 210 may be increased or decreased to affect the particle size/density or grade of material collected. The material collected using the new operating parameters may then be tested. Using an iterative process, the process parameters required to obtain the desired particle size/density or grade of material at each wheel may be determined for a particle aggregate feed.

Figure 15:
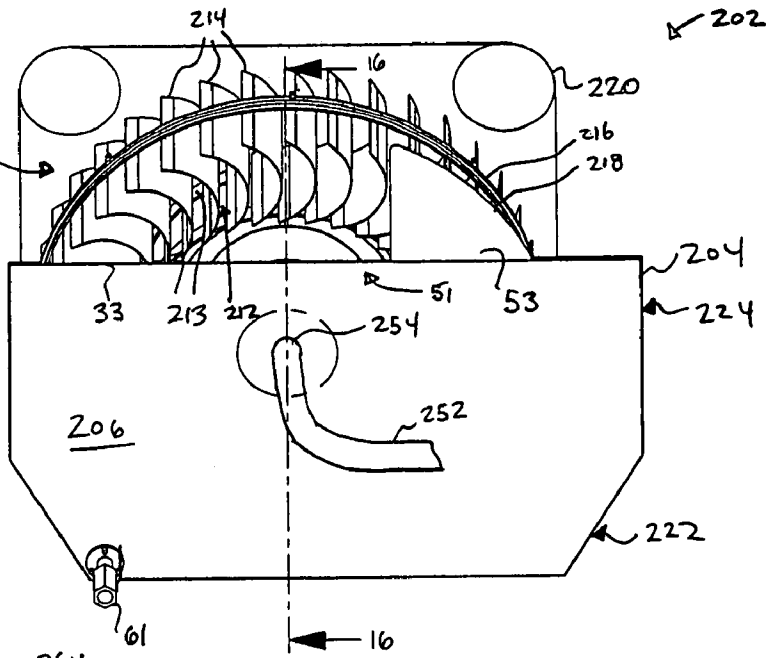
FIG. 15 is a side view of a further embodiment of a material classifier constructed according to embodiments of the present invention.

As shown in FIGS. 15 and 16, the side wall 206 may include a housing 251 which defines a reservoir 250. The housing 251 is received within the inner hub 212 of the wheel 210. In the shown embodiment, the housing 251 comprises a generally cylindrical housing which is attached to inner surface of the side wall 206, however other shapes may also be used. In other embodiments, the housing 251 may be formed by a recess in the side wall 206. An inlet pipe 252 is coupled to the reservoir 250 through an opening 254 in the side wall 206. In the shown embodiment, the inlet pipe 252 and the reservoir 250 are generally inline (coaxial) with the wheel axis. The inlet pipe 252 is connected to a water source, such as a water pump (not shown), which feeds water into the reservoir 250. A pair of plates is disposed opposite the inlet pipe 252 forming an end of the reservoir 250. The plates include an inner plate 262 and an outer plate 264. The inner plate 262 defines a plurality of openings or holes which allow water from the reservoir 250 to exit therethrough. The inner plate 262 may also include hollow conduits or nozzles 266 attached to the inner side thereof in communication with the openings in the inner plate 262. In other embodiments, the inner plate 262 has openings but does not include nozzles. Further, the size and shape of the openings may vary across the inner plate 262. In some embodiments, the inlet pipe 252 has a diameter of 1-2" and feeds a reservoir 250 having a diameter of 14". In some example embodiments, the inner plate 262 may be positioned approximately 12" from the side wall 206 defining a depth of the reservoir 250 and the nozzles 266 may be ½" in diameter.

Figure 19:
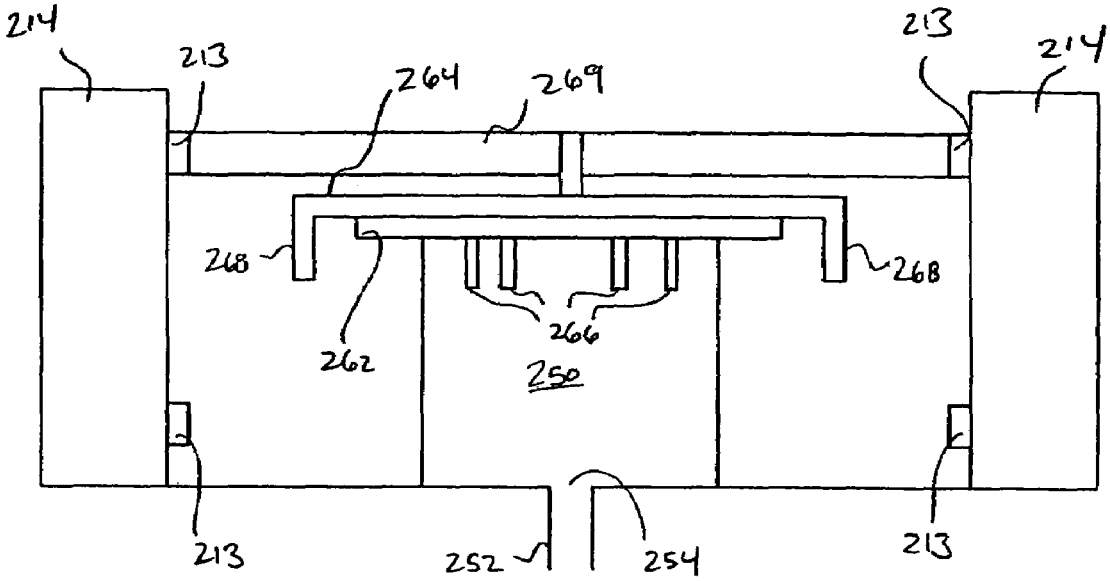
FIG. 19 is an exploded view of the scoop wheel of the material classifier of FIG. 15 showing the inner and outer plates mounted to the inner hub.

The outer plate 264 is fixed to inner hub 212 of the wheel 210. As shown in FIG. 15 to 17, 19 and 21, in the shown embodiment the outer plate 264 is attached to the concentric rings 213 of the inner hub 212. The outer plate 264 includes a circumferential guide ring 268 extending inwardly towards the side wall 206 when the wheel is suspended within the tank 204. The diameter of the guide ring 268 is larger than the diameter of the inner plate 262 providing some clearance thereabout. When not in operation and when no water is flowing from the inlet pipe 252, the outer plate 264 is positioned against and partially supported by the inner plate 262. As a result of the contact between the inner plate 262 and outer plate 264, solid material being classified, such as sand, typically cannot enter the reservoir 250. As shown in FIG. 19, a cross-member 269 fixes the outer plate 264 to the outer of the concentric rings 213 of the inner hub 212. A sufficient clearance is provided between the guide ring 268 and the inner plate 262 to allow the wheel 210 to float thereabout during its rotation about its wheel axis.

In some embodiments, the inner plate 262 defines 6 evenly distributed openings. The number, size and distribution of the openings in the inner plate 262 may vary depending on the water pressure that is to be applied against the wheel 210 and the distribution required to create the water cushion and balance the wheel 210. In some applications, the water distributed by the inner plate 262 should balance the wheel to facilitate its rotation.

During operation, water from the inlet pipe 252 fills the reservoir 250. As the water pressure within the reservoir 250 increases, water is discharged through the nozzles 266 and ultimately through the openings in the inner plate 262. Water discharged through the openings in the inner plate 262 presses against the outer plate 264, pushing the wheel 210 away from the side wall 206 and creating a small buffer or space between the wheel 210 and the side wall 206. The space created between the wheel 210 and the side wall 206 fills with water from the reservoir 250 creating a water cushion as the wheel 210 rotates about its wheel axis. This water cushion allows the wheel 210 to be rotated without riding directly on the side wall 206, thereby reducing the friction that would otherwise occur. Without being bound by theory, the discharge of water through the inner plate 262 may, in some applications, provide a water cushion or hydroplaning effect providing lubrication between the inner plate 262 and outer plate 264 thereby reducing wear.

Because of the clearance between the inner plate 262 and the guide ring 268 on the outer plate 264, the wheel 210 is able to float about the inner plate 262 within the confines of the guide ring 268. In some applications, a benefit of this clearance may be that the wheel 210 may be suspended and rotating about its wheel axis without tight tolerances, thereby simplifying the construction of the material classifier 202 and making it less costly to manufacture. A further advantage, in some applications, may be that the risk of stalling the material classifier 202 is reduced because tight tolerances are not used, for example, at the principle moving parts such as the points of rotation. The use of tight tolerances may increase the risk of stalling because the sand or other solid material being classified may cause clogging or binding. Stalling may, in some applications, require the classifier tank to be dug out manually by an operator.

Figure 20:
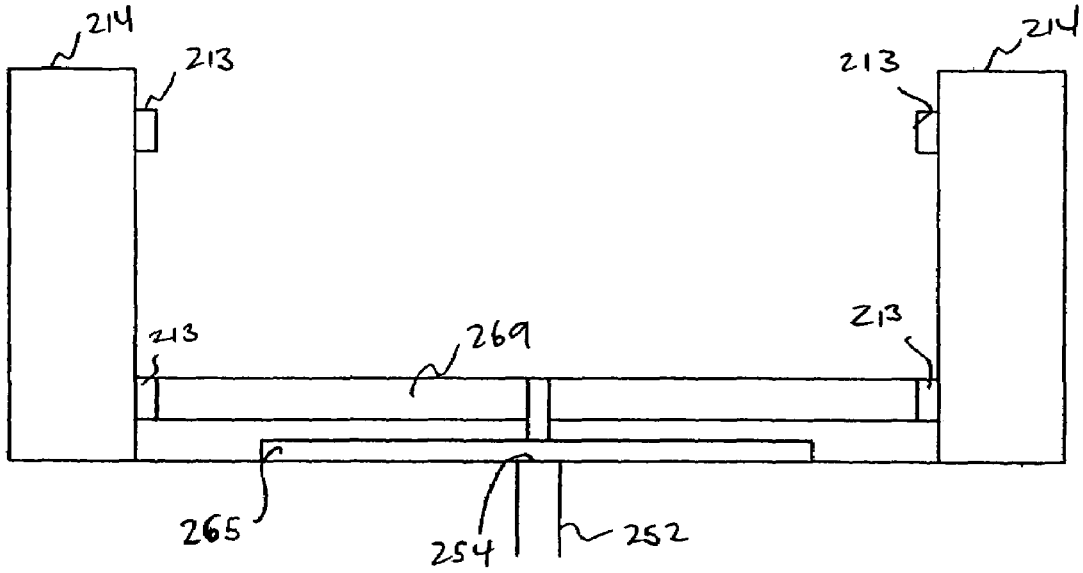
FIG. 20 is an exploded view of the scoop wheel of a material classifier similar to that shown in FIG. 19 except that a single plate is mounted to the inner hub.
Figure 21:
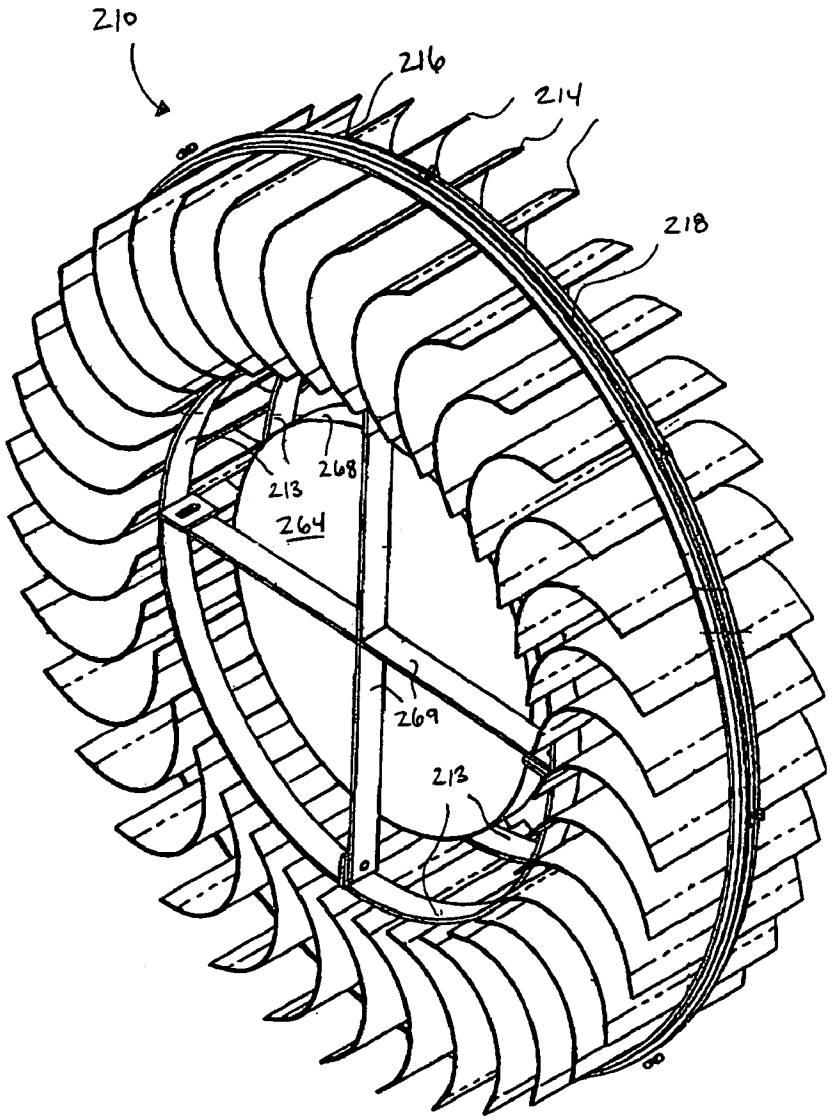
FIG. 21 is a perspective view of the scoop wheel of the material classifier of FIG. 15.

An alternative embodiment of the present invention shown in FIG. 20 in which the inner plate 262 is eliminated and a single plate 26 similar to the outer plate 264 is positioned adjacent to the opening 254 for receiving water under pressure from the water source in the side wall such that the scoop wheel can rotate thereabout when it is rotated about its wheel axis. In this embodiment, the plate 265 does not include a guide ring 268 as did the outer plate 264. The cross-member 269 is used in this embodiment to secure the plate 265 to the inner of the concentric rings 213 of the inner hub 212. The wheel 210 is allowed to float about the plate 265 during its rotation about its wheel axis. Without a guide ring 268, the freedom of movement of the wheel 210 may be more than that the previously described embodiment shown in FIG. 15 to 19. During operation, a water cushion is created between the outer plate 264 and the side wall 206 by the water from the inlet pipe 252 press against the plate 265.

In some embodiments of the material classification systems described above, one or more of the material classifiers may include side (guide) rollers positioned about the scoop wheel to limit lateral (side-to-side) movement of the scoop wheel so as to reduce or prevent the scoop wheel from contacting or damaging other components of the classifier (e.g. lateral partitions separating the tanks or the end walls of the tank). In some embodiments, the side rollers are positioned above an axis of rotation of the scoop wheel. In some embodiments one or more material classifiers include a pair of side rollers positioned on opposite sides of the scoop wheel, above its axis of rotation.

According to another example embodiment, there is provided a material classifier for classifying a liquid-solid mixture containing solid material to be separated, comprising: a tank defining a reservoir for receiving the liquid-solid mixture; a drive belt; and a scoop wheel suspended from the drive belt at least partially within the tank to rotate about a wheel axis, the scoop wheel including a plurality of circumferentially spaced apart scoops for scooping material from the tank and subsequently discharging the scooped material from the tank during rotation of the scoop wheel.

According to a further example embodiment, there is provided a material classifier for classifying aggregate material, comprising: a support frame; a tank mounted to the support frame for receiving a mixture of aggregate material and fluid, the tank having a side wall with a slanting, upward facing surface; a scoop wheel having a plurality of radially extending scoops for scooping aggregate material from the tank, the scoop wheel being located adjacent the upward facing surface and having a plate substantially parallel to and facing the upward facing surface; a suspension drive system for driving the scoop wheel, the suspension drive system including a pair of spaced apart belt guides secured to the support frame and an endless belt passing through the guides, the scoop wheel being suspended from the belt between the guides for rotation in a direction substantially parallel to the upward facing surface; and a pressurized fluid source for applying pressurized fluid to the plate of the scoop wheel to bias the wheel away from the upward facing surface; the scoop wheel and side wall being arranged such that in use the scoops discharge aggregate material scoped from the tank over an edge of the side wall.

In some embodiments, the scoop wheels are arranged in series.

In some embodiments, the scoop wheels may be independently controllable permitting the scoop wheels to be rotated at separate speeds and in separate directions.

In some embodiments, the classification system may comprise an inlet at a first end of the tank for feeding the liquid-solid mixture into the inlet channel, and an outlet at an opposite second end of the tank for receiving overflow from the tank.

In some embodiments, the classification system comprise angularly mounted discharge chutes attached to an outer surface of the tank opposite each of the scoop wheels, the discharge chutes being attached at an upper edge of the tank.

In another embodiment, there is a provided a method of classifying material. According to one example embodiment, there is provided a method of classifying material, comprising the steps of: introducing a liquid-solid mixture into a tank to a predetermined fill level; rotating a scoop wheel about a wheel axis to scoop settled solid material from a bottom of the tank, the wheel axis being positioned at an acute angle relative to a vertical reference; and rotating the scoop wheel further to discharge the scooped material from the scoop wheel when the scooped material is above an upper edge of the tank.

In some embodiments, the scoop wheel is rotated at angle of greater than 30 degrees and less than 90 degrees relative to the vertical reference.

In some embodiments, the scoop wheel is rotated at angle of greater than 40 degrees and less than 70 degrees relative to the vertical reference.

In some embodiments, the scoop wheel is rotated at angle of greater than 50 degrees and less than 60 degrees relative to the vertical reference.

Figure 23:
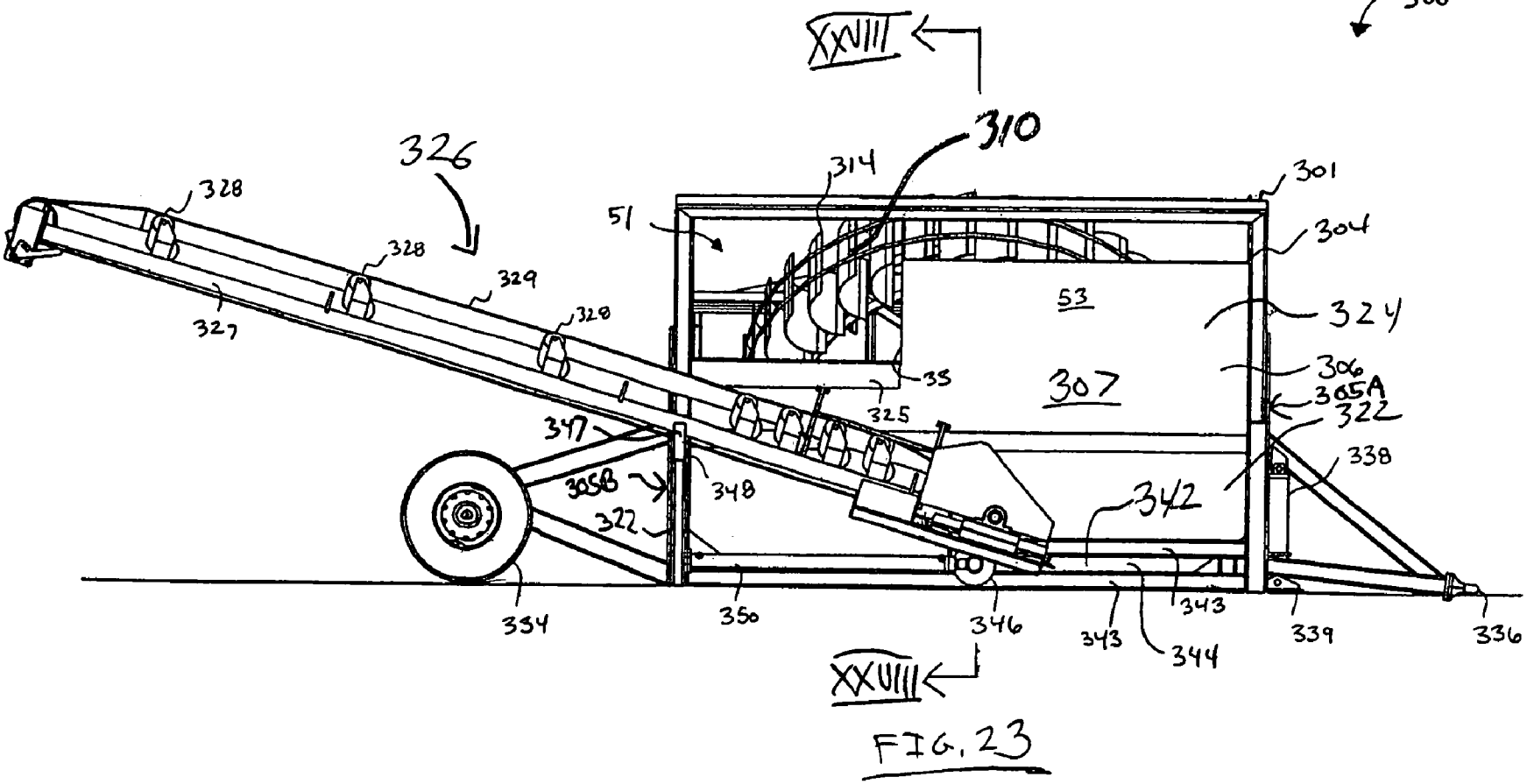
FIG. 23 is a side view of a material handling system according to one embodiment of the present invention.
Figure 27:
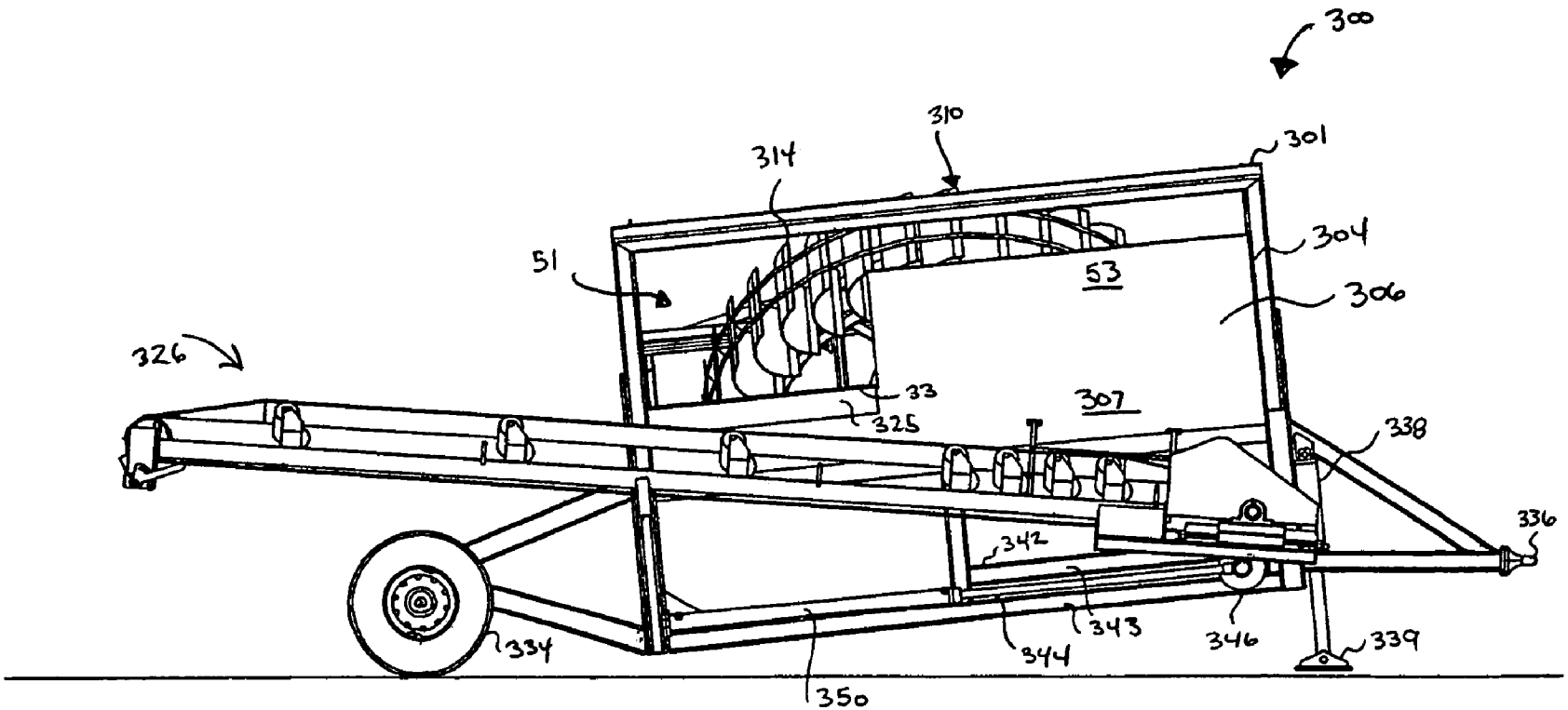
FIG. 27 is a side view of the material handling system of FIG. 23 in a position suitable for transportation.
Figure 28:
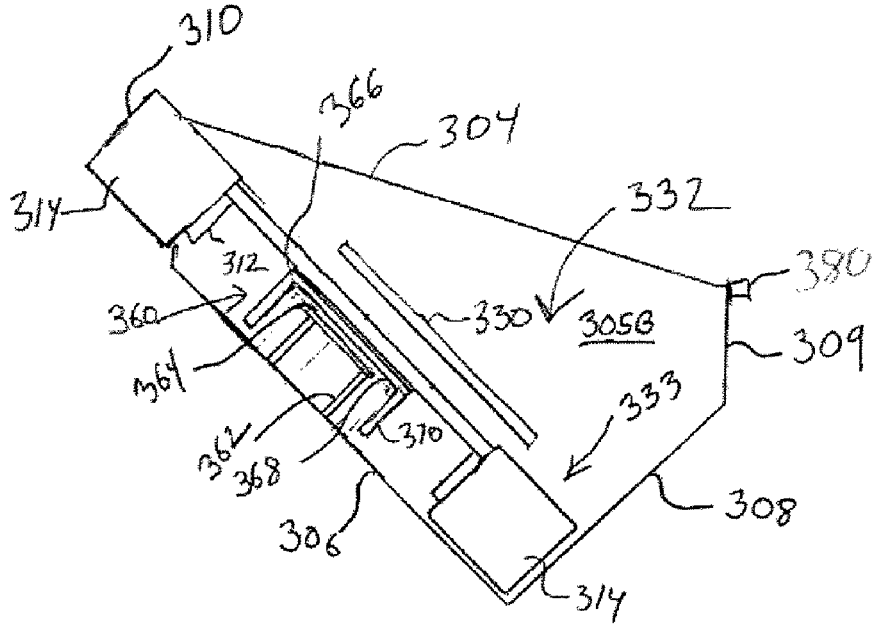
FIG. 28 is partial sectional schematic view taken along the lines XXVIII-XXVIII of FIG. 23.

It will be appreciated that the embodiments described above, in addition to classifying and or separating materials, can move material from one location to another. Thus, embodiments can be configured for handling dry materials without performing a separating or classifying function. Referring now to FIG. 23 to 29, example embodiments of a material handling system 300 for handling dry materials will be described. As best seen in FIGS. 25 and 28, the material handling system 300 comprises a tank or hopper 304 having end walls 305A and 305B, an angled side wall 306, an angled bottom wall 308, and a further sidewall 309 defining a reservoir for receiving solid material. The tank 304 is mounted on a material handling system support frame 301. The side wall 306 is positioned at an angle θ relative to a horizontal reference. As seen in FIGS. 23 and 28, a wheel 310 is suspended at least partially within the tank 304 to rotate about a wheel axis that is substantially perpendicular to the side wall 306.

The wheel 310 includes a hub 312 and a plurality of spaced apart scoops 314 extending radially from the hub 312 for scooping material which has settled on the bottom wall 308 and subsequently discharging the scooped material from the tank 304 during rotation of the wheel 310 about its wheel axis.

As best seen in FIG. 23, the side wall 306 includes a lower portion 322 adjacent the wheel 310 for impeding scooped material from discharging from the scoops 314 while rotating inside the tank 304, and an upper portion 324 defining a discharge area or opening 51 through which scooped material is discharged. The upper portion 324 may also include a guard plate 53 which impedes scooped material from discharging from the scoops 314 before reaching the discharge opening 51 on the upper portion of the scoop rotation.

An outwardly directed plate or discharge chute 325 may be positioned below the discharge opening 51 to receive discharged material and direct it onto a conveyor belt to transport discharged scooped material elsewhere, for example to a discharge pile. In the shown embodiment, the discharge chute 325 is attached to an upper edge 33 of the side wall lower portion 322. The scoops 314 discharge scooped material when rotated higher than the discharge opening 51/upper edge 33. In the shown embodiment, the bottom wall 308 is substantially perpendicular to the side wall 306, although the angle between bottom wall 308 and side wall 306 could be different than 90 degrees and can depend on the actual configuration of scoops 314.

As shown in FIG. 23 to 27, the material handling system 300 in an example embodiment includes a conveyor belt 326 having opposite first (loading) and second (discharge) ends. The conveyor belt 326 is mounted to the same frame 301 that supports the tank 304 and wheel 310 in such a manner that the conveyor belt can be moved relative to the tank 304 between operating and transport positions. The conveyor belt 326 includes a conveyor frame 327 having a plurality of guide rollers 328 supporting an endless belt 329. A horizontal track 342 is located on a lower portion of the frame 301. The track 342 includes a pair of parallel rails 343 that define the longitudinally extending channel 344 therebetween.

A cantilever support beam or member 348 (see FIGS. 23 and 26) extends laterally from the material handler frame 301 to support the frame 327 of the conveyor belt 326 at a location between the ends of the conveyor belt. In the illustrated embodiment the cantilever support member 348 is rigidly fixed to the material handler frame 301, however in an alternative embodiment the support 348 is manually or automatically adjustable in at least the vertical axis, and in a further embodiment the support 348 is adjustable in both the vertical and horizontal axes. In an example embodiment, a loading end of the conveyor belt frame 327 is slidably supported in guides 347 that are connected to the cantilever support member 348. A sliding cantilever support member 346 (see FIGS. 23 and 25) is rigidly attached to the loading end of the conveyor belt 326 at a lower portion thereof. The sliding support member 346 has an end portion that extends laterally from the conveyor belt frame 327 and that is received in the channel 344 for sliding movement between opposite ends of the channel 344. In the shown embodiment, the sliding support 346 is slideable between a first end of the channel 344 corresponding to an operating position of the conveyor belt (see FIG. 23) in which the discharge end of the conveyor is elevated and extended relative to the handling system frame 301, and a second end of the channel 344 corresponding to a transport or storage position of the conveyor belt (see FIG. 27) in which the discharge end of the conveyor is lowered and retracted relative to the handling system frame 301.

Figure 25:
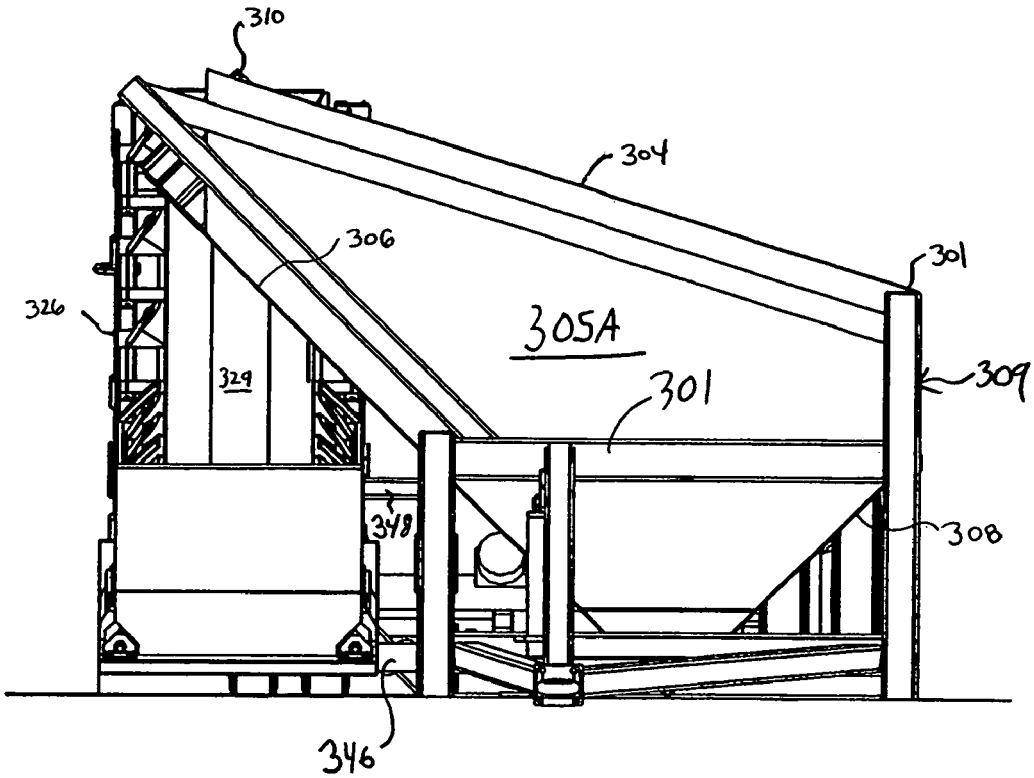
FIG. 25 is an end view of the material handling system of FIG. 24 taken along the line 25-25.
Figure 26:
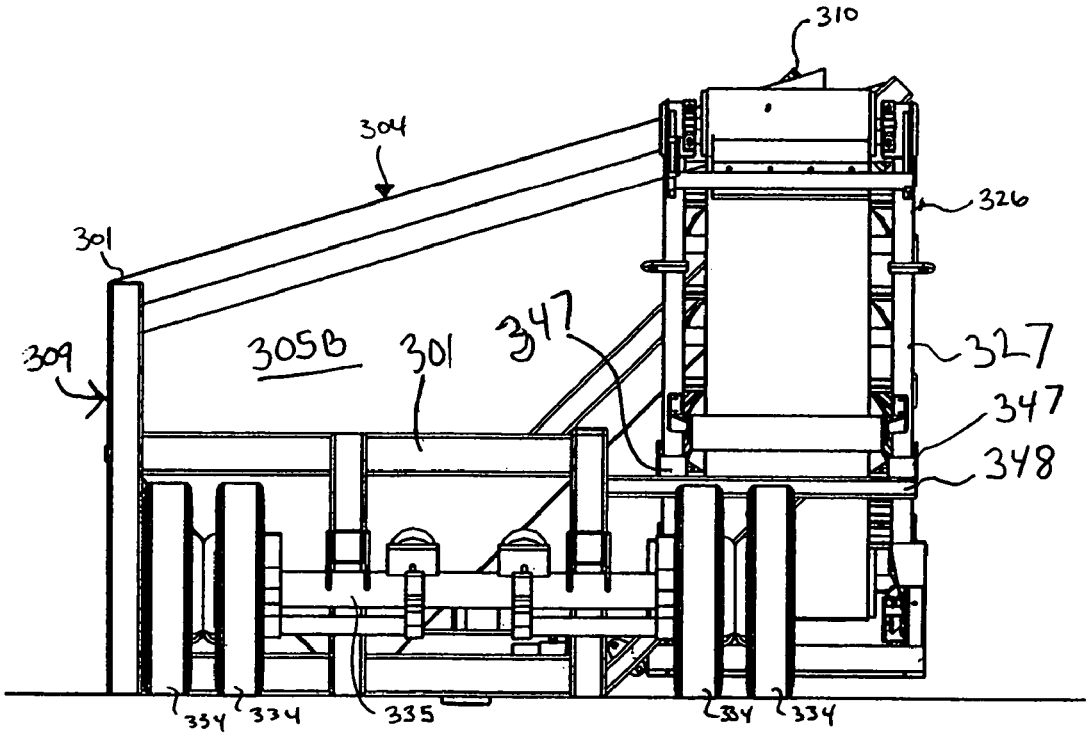
FIG. 26 is an end view of the material handling system of FIG. 24 taken along the line 26-26.

As can best be seen in FIGS. 25 and 26, the loading end of the conveyor belt 326 is basically located at least partially under the angled wall 306. According to some embodiments, when in the elevated/extended position, the conveyor belt 326 is in a suitable position for operation of the material handling system 300. When in the lowered/retracted position, the conveyor belt 326 is in a suitable position for transportation of the material handling system 300. In some embodiments, the conveyor belt 326 may be operated at one or more angular positions between the elevated and lowered positions, allowing the angle of inclination of the conveyor belt 326 to be adjusted. In the shown embodiment, an extendable linear actuator 350 is operably connected between the material handler support frame 301 and the rotatable guide 346 for sliding the slideable support member 346 back and forth along track 342 in order to extend/raise and retract/lower the conveyor belt 326. The extendable actuator 350 may, for example, be a pneumatic or hydraulic cylinder. In the shown embodiment, the actuator 350 is operably connected for movement along a generally horizontal axis between a first position corresponding to the extended/elevated position of the conveyor belt 326 (as shown in FIG. 23), and an second position corresponding to the retracted/lowered position of the conveyor belt 326 (as shown in FIG. 27).

In various embodiments, the conveyor belt 326 could be mounted to the material handler frame 301 using mounting configurations other than as described above. For example the conveyor belt could have a folding discharge end portion that folded 180 degrees between operating and transport positions. Alternatively, in some embodiments a conveyor belt is not fixed to the material handler frame 301, but rather the material hander unloads material onto an independent conveyor belt or alternative material receiving platform.

Figure 24:
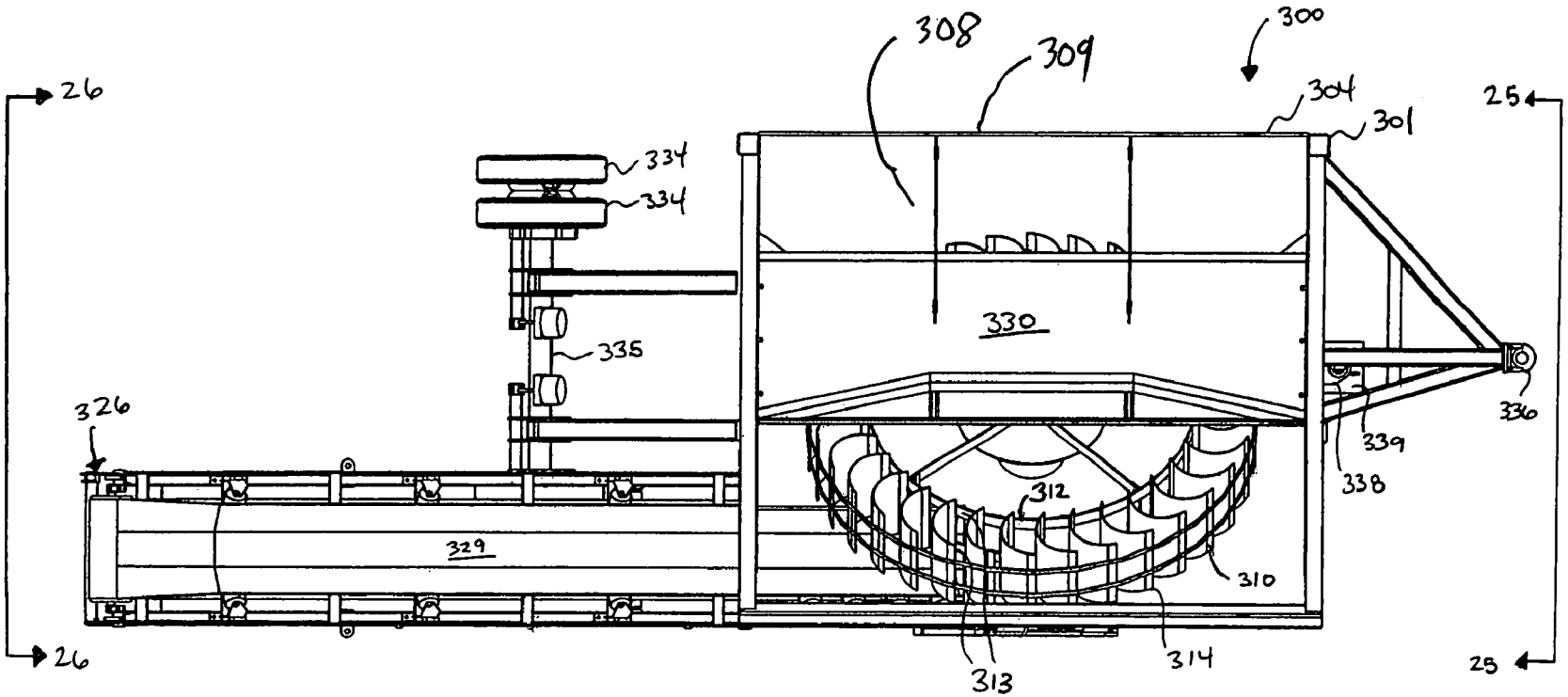
FIG. 24 is a top view of the material handling system of FIG. 23.

As shown in FIG. 24 and FIG. 28, the material handling system 300 may also include within the tank 304 a baffle plate or restricting wall 330 defining with an outer wall 309 and base wall 308 of the tank 304 a hopper or inlet channel 332 for receiving material for delivery to wheel 310. In the shown embodiment, the restricting wall 330 is located on a side of the wheel 310 opposite the side wall 306, and is generally parallel to the side wall 306 and/or the inner side of the wheel 310. The restricting wall 330 extends between end walls 305A and 305B, and defines a lower opening 333 between a bottom edge portion of the restricting wall 330 and the bottom wall 308 of the tank 304 so as to allow solid material to pass therethrough to be scooped up by the wheel 310. In operation, the restricting wall 330 bears a significant portion of the impact from solid material being dumped over wall 309 into the tank 304.

The material handling system 300 also includes wheels 334 mounted on a common axle 335 located at one end of the support frame 301. In the shown embodiment, a pair of wheels 334 is located on each side of the axle 335. A hook 336, ball mount, or other connector for connecting to a hitch for a truck or other vehicle is positioned on the opposite end of the support frame 301. In the shown embodiment, the wheels 334 are located at the end opposite the track 342.

The material handling system 300 may also include an extensible linear actuator or support leg 338. In the shown embodiment, the extensible support leg 338 is located on the same end as the hook 336 or other connector for the hitch. The support leg 338 may include a foot 329 at the lower end thereof. In the shown embodiment, the extensible support leg 338 is pneumatically or hydraulically controllable by a corresponding pneumatic or hydraulic cylinder. As shown in FIG. 27, when the material handling system 300 is to be transported, the extensible support leg 338 is extended to raise the end of the system 300 having the hook 336 or other connector. In this position, the material handling system 300 can be connected to a truck for towing.

Figure 29:
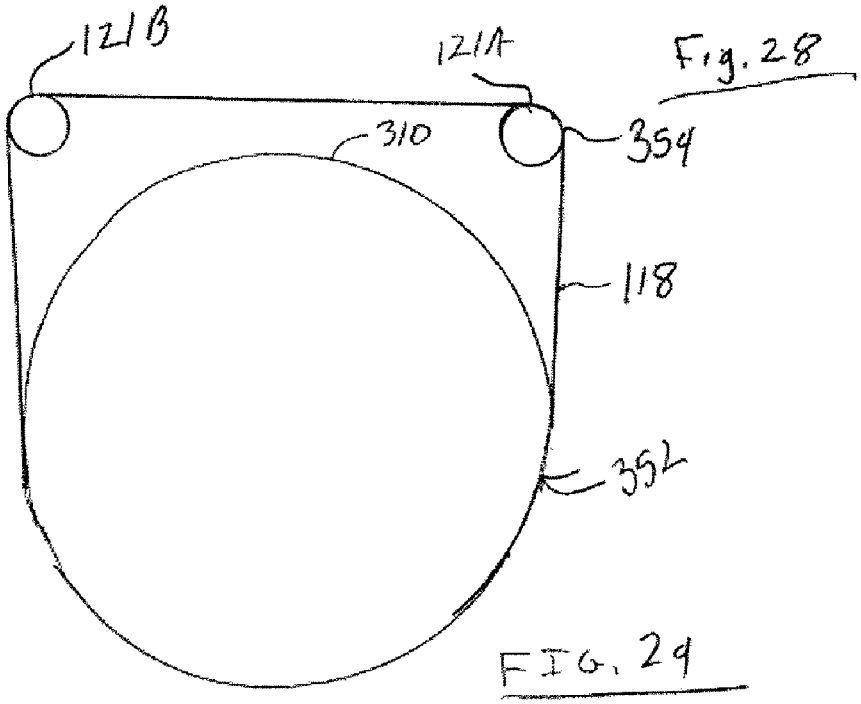
FIG. 29 is a schematic view illustrating a suspended drive system for the material handling system of FIG. 23.

In at least some example embodiments, the material handling system 300 has a suspended drive system for the scoop wheel 310 similar to that of the previously described material classifier systems 100 and 200 and shown in FIGS. 10, 11. FIG. 29 diagrammatically illustrates a suspended drive system in which the wheel 310 is partially supported by and is driven by a drive belt 118 which is supported by sprockets or guide wheels 121B and 121A mounted directly or indirectly to frame 301. The wheel 310 may also include a circumferential guide or track 352 for cooperating with the drive belt for rotating the scoop wheel 310 about its wheel axis. The guide is provided around an outer circumference of the scoop wheel 310 in the illustrated embodiments, however it could be located elsewhere, for example around an inner hub, in other embodiments. The guide 352 may be similar to the guide 216 or 116 described earlier.

The drive belt 118 is at least partially received within the guide 352. A drive actuator 354 similar to the drive 120 or 220 described earlier is provided for driving the belt to rotate the wheel 310 within the tank 304. The drive engages and drives the drive belt 118 so as to rotate the wheel 310 about its wheel axis. The drive belt may be similar to the drive belt 118 or 218 described earlier.

In example embodiments, some of the weight of the wheel 310 is carried by the side wall 306, and FIG. 28 shows one example of a support interface 360 between the side wall 306 and wheel 310 with reference to FIG. 28. The interface 360 between the wheel 310 and the sidewall 306 is similar to that described above in respect of FIGS. 16, 17 and 19, however in at least one example embodiment the interface 360 is a dry interface in that pressurized water is not axially applied against the wheel as in the classifier 200. In the configuration of FIG. 28, a cylindrical support member 362 extends from the wall 306 and terminates at a circular support plate 364 that has a substantially planar load bearing surface facing away from an inner surface of wall 306. The wheel 10 has a central hub assembly 366 that includes a central circular bearing plate 368 opposing the support plate 364. The hub assembly 366 includes a cylindrical wall 370 that extends at least part of the distance to the sidewall 306 from around a circumference of the bearing plate 368. In operation, the bearing plate 368 rotates against the face of support plate 364. Plates 364 and 368 may be selected from hardened or other materials that will resist wear and/or friction. The wall 370 has a diameter greater than that of the support plate 364, thereby permitting limited floating of the wheel 310 parallel to the plane of the wall 306 as well as perpendicular to the plane of the wall 306. The interface 366 may take different configurations than the example configuration described above—for example, among other possible configurations, bearing wall 368 could engage wall 306 directly in some configurations.

The wheel 310 is suspended from the drive belt, and the wheel/side wall interface 360 is configured, so as to maintain an operating distance between the wheel 310 and the bottom wall 308.

With reference to FIGS. 23 and 28, during operation of the material handling system 300, a load of material deposited into the intake region or channel 332 of tank 304 passes through opening 333 under the restricting wall 330 to be picked up by scoops 314. As the scoops rotate, the material is discarded through the opening 51 in the wall 206 onto a loading end of conveyor belt 326, and then subsequently discharged from the remote discharge end of the conveyor. In some applications, a dump truck may back up to opposite side wall 309 and discharge a load of material over the top edge of wall 309 into the channel 332.

In some embodiments, the material handling system 300 includes a limit switch or other proximity sensor 380 on wall 309 or on frame 301 near wall 309. The sensor 380 is operably connected to the control circuitry of the material handling system 300 to activate and deactivate the material handling system 300 upon detecting the presence of a truck at wall 309. For example, in one embodiment a limit switch is positioned on the support frame 301 to be engaged by a truck or other vehicle which backs up to the system 300. When the truck contacts the limit switch (e.g. the rear bumper of the truck), the limit switch activates the system 300. When the truck pulls away from the system, the limit switch deactivates the system 300. Alternatively, a sensor that sensed the presence of a load within the channel 332 could be used to activate the system 300.

In some example embodiments, the angle θ of the side wall 306 relative to the horizontal reference is greater than 30 degrees and less than 90 degrees. In other embodiments, the angle θ of the side wall 306 relative to the horizontal reference is greater than 40 degrees and less than 70 degrees, and in some embodiments, the angle θ of the side wall 306 relative to the horizontal reference is greater than 50 degrees and less than 60 degrees. In one example embodiment, the angle θ of the side wall 306 relative to the horizontal reference is approximately 56 degrees. The above examples are merely illustrative and other angles may be employed in different embodiments.

In some applications, the material handling system 300 may be used to unload salt and/or sand, for example within a salt dome or for open storage. Other types of solid material such as aggregate may also be unloaded using the material handling system 300. In some applications, a mixture of solid material may be formed in a discharge pile by alternating the material which is unloaded. For example, a mixture of salt and sand may be obtained by properly proportioning the loads of solid material dumped on a discharge pile (e.g. 3 loads of sand per load of salt to obtain a 3:1 sand-to-salt ratio). Some mixing will occur as the material is dumped from the conveyor belt 326. Supplemental mixing will also occur when the unloaded material is scooped up from the discharge pile by loaders. In other applications, two or more types of solid material may be dumped into the tank 304 at approximately the same time, allowing the material handling system 300 to serve as both a solid-solid mixer and an unloader.

In the example embodiment of material handler 300 described above and shown in the drawings, the wheel 310 (similar to above-described scoop wheels 102 and 210) is supported in part by the drive belt 118 and in part by the side wall 306 through interface 360. Such configuration allows the wheel 310 a degree of movement or float relative to the sidewall 306 in both a radial direction (i.e. parallel to the wall 306) and in an axial direction (i.e. perpendicular to the wall 306). In the illustrated embodiment, the degree or extent of such float or movement is determined by the configuration and dimensions of the interface 360 as well as the configuration and dimensions of the suspended drive belt system. It will be appreciated that in alternative embodiments other drive systems can be employed to permit floating movement of the scoop wheel. For example, in place of or in addition to drive belt 118, drive wheels (not shown) could be placed in direct contact with the scoop wheel 310 (or wheels 102 and 210) to support and/or turn the scoop wheel.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A material handling system, comprising:

a reservoir for receiving material, the reservoir including an angled sidewall;

a scoop wheel rotatably positioned within the reservoir substantially parallel to the sidewall to rotate about a wheel axis that is tilted relative to a horizontal reference, the scoop wheel being mounted to permit movement of the scoop wheel in directions both parallel to and perpendicular to the sidewall during rotation thereof and including a plurality of circumferentially spaced apart scoops for scooping material from the reservoir tank and subsequently discharging scooped material from the reservoir during rotation of the scoop wheel about its wheel axis.

2. The material handling system as claimed in claim 1, including a support frame supporting the reservoir and further including a conveyor belt mounted to the support frame.

3. The material handling system of claim 2 wherein the conveyor belt is mounted to the support frame for movement between an operating position and a further position, wherein a discharge end of the conveyor belt is located further from the reservoir in the operating position than in the further position.

4. The material handling system of claim 3 wherein the support frame includes wheels at one end thereof for facilitating transport of the material handling system.

5. The material handling system as claimed in claim 1, wherein the sidewall defines a discharge opening through which scooped material is discharged when rotated higher than a lower edge of the discharge opening.

6. The material handling system as claimed in claim 1, further comprising a restricting wall positioned in a portion of the reservoir adjacent the scoop wheel for impeding material entering the reservoir from landing on selected portions of the scoop wheel, the restricting wall defining an opening with a bottom wall of the reservoir for feeding material to a lower portion of the scoop wheel.

7. The material handling system as claimed in claim 1 and including a drive belt from which the scoop wheel is at least partially suspended for driving the drive belt to rotate the scoop wheel about its wheel axis.

8. The material handling system of claim 7 wherein the drive belt includes a chain or a cable.

9. The material handling system of claim 7 wherein the sidewall partially supports the scoop wheel.

10. The material handling system of claim 9 including a support interface between the sidewall and the scoop wheel, the support interface including a substantially planar plate secured to and spaced apart from the sidewall for supporting the scoop wheel.

11. The material handling system of claim 1 further including a sensor for sensing at least one of (a) the presence of material in the reservoir; and (b) the presence of a vehicle placing material in the reservoir, the sensor being operatively connected to the scoop wheel for triggering an operation thereof.

12. A material handling system, comprising:

a support frame;

a tank mounted to the support frame and having an angled side wall and a bottom wall, the tank defining a reservoir for receiving material; and a scoop wheel rotatably positioned within the tank substantially parallel to the side wall to rotate about a wheel axis that is tilted relative to a horizontal reference, the scoop wheel including a plurality of circumferentially spaced apart scoops for scooping material from the tank and subsequently discharging scooped material from the side wall of the tank during rotation of the scoop wheel about its wheel axis, the scoop wheel being suspended from a drive belt with the side wall supporting some of the weight of the scoop wheel wherein the scoop wheel can float relative to the sidewall during rotation thereof.

13. The material handling system of claim 12 including a conveyor belt mounted to the support frame for receiving material discharged from the scoop wheel, wherein the conveyor belt is mounted to the support frame for movement between an operating position and a further position, wherein a discharge end of the conveyor belt is located further from the reservoir in the operating position than in the further position.

14. The material handling system of claim 13 wherein the in the operating position the discharge end is extended and raised relative a location of the discharge end in the further position.

15. The material handling system of claim 13 wherein a loading end of the conveyor belt is mounted for sliding horizontal movement to the support frame.

16. The material handling system of claim 12 and further including a sensor for sensing at least one of(a) the presence of material in the reservoir; and (b) the presence of a vehicle placing material in the reservoir, the sensor being operatively connected to the scoop wheel and the conveyor belt for triggering an operation thereof.

17. The material handling system of claim 12, further comprising:

a restricting wall positioned in a lower portion of the tank adjacent the scoop wheel, the restricting wall protecting a portion of the scoop wheel from material entering the tank and defining with a further wall of the tank an inlet channel for receiving material for feeding to a lower portion of the scoop wheel.

18. The material handling system as claimed in claim 12, wherein the side wall includes an upper edge over which the scoops discharge the scooped material when rotated higher than the upper edge.

19. The material handling system as claimed in claim 12 including an interface structure located between the sidewall and the scoop wheel for supporting some of the weight of the scoop wheel.

* * * * *